US009657520B2

(12) United States Patent
Altimas et al.

(10) Patent No.: US 9,657,520 B2
(45) Date of Patent: May 23, 2017

(54) WIRED OR PORTED TRANSMISSION SHAFT AND UNIVERSAL JOINTS FOR DOWNHOLE DRILLING MOTOR

(71) Applicant: Weatherford/Lamb, Inc., Houston, TX (US)

(72) Inventors: Gregory Richard Altimas, Nisku (CA); Rishi Shankar Gurjar, Nisku (CA); Andrew Went, Nisku (CA)

(73) Assignee: Weatherford Technology Holdings, LLC, Houston, TX (US)

( * ) Notice: Subject to any disclaimer, the term of this patent is extended or adjusted under 35 U.S.C. 154(b) by 763 days.

(21) Appl. No.: 13/974,257

(22) Filed: Aug. 23, 2013

(65) Prior Publication Data

US 2015/0053485 A1 Feb. 26, 2015

(51) Int. Cl.

| | |
|---|---|
| ***E21B 4/02*** | (2006.01) |
| ***E21B 47/06*** | (2012.01) |
| ***E21B 47/12*** | (2012.01) |

(52) U.S. Cl.

CPC ..... *E21B 4/02* (2013.01); *E21B 47/06* (2013.01); *E21B 47/122* (2013.01)

(58) Field of Classification Search

CPC ..... E21B 4/02; E21B 47/06; E21B 47/122
See application file for complete search history.

(56) References Cited

U.S. PATENT DOCUMENTS 4,157,022 A * 6/1979 Crase ..... F16D 3/84 464/11
4,772,246 A 9/1988 Wenzel
(Continued)

FOREIGN PATENT DOCUMENTS

AU 2013200954 9/2013
CN 103132926 6/2013
(Continued)

OTHER PUBLICATIONS

First Examination Report in counterpart Australian Appl. 2013200954, dated Jul. 21, 2014.
(Continued)

*Primary Examiner* — Robert E Fuller
*Assistant Examiner* — David Carroll
(74) *Attorney, Agent, or Firm* — Blank Rome LLP

(57) ABSTRACT

A bottom hole assembly for a drill string has a mud motor and a mandrel. The motor has a rotor driven by drilling fluid flow, and the rotor defines a bore for passage of fluid flow and/or conductors. The mandrel has a bore for passage of the conductors and/or fluid flow, and rotation of the mandrel rotates a drill bit. A shaft and universal joints transfer the drive of the rotor to the mandrel. To pass the conductors from a sonde uphole of the motor to electronics disposed with the mandrel and/or to conduct fluid flow, inner beams dispose in a bore of the shaft to seal at the ends of the shaft coupled to the first and second universal joints. Each beam has an internal passage for the conductors and/or fluid flow. One of the universal joints and inner beams compensate for eccentricity in motion of the rotor, while the other second universal joint and inner beam compensate for a bend in the downhole assembly. Each of the inner beams is at least partially flexible to compensate for articulation at the universal joints.

38 Claims, 11 Drawing Sheets

(56) References Cited

U.S. PATENT DOCUMENTS

| | | | | |
|---|---|---|---|---|
| 4,904,228 | A * | 2/1990 | Frear | E21B 17/05 464/152 |
| 4,982,801 | A | 1/1991 | Zitka et al. | |
| 5,000,723 | A | 3/1991 | Livingstone | |
| 5,048,622 | A | 9/1991 | Ide | |
| 5,160,925 | A | 11/1992 | Dailey et al. | |
| 5,205,789 | A | 4/1993 | Falgout, Sr. | |
| 5,267,905 | A | 12/1993 | Wenzel et al. | |
| 5,288,271 | A | 2/1994 | Nelson et al. | |
| 5,520,256 | A | 5/1996 | Eddison | |
| 5,704,838 | A | 1/1998 | Teale | |
| 5,725,061 | A * | 3/1998 | Van Steenwyk | E21B 4/02 175/104 |
| 6,392,561 | B1 | 5/2002 | Davies et al. | |
| 6,540,032 | B1 | 4/2003 | Krueger | |
| 6,949,025 | B1 | 9/2005 | Kraus et al. | |
| 7,186,182 | B2 | 3/2007 | Wenzel et al. | |
| 7,303,007 | B2 | 12/2007 | Konschuh et al. | |
| 7,624,819 | B1 | 12/2009 | LeBlanc et al. | |
| 7,708,086 | B2 | 5/2010 | Witte | |
| 7,766,098 | B2 | 8/2010 | Farley | |
| 7,832,503 | B2 | 11/2010 | Sand et al. | |
| 8,033,917 | B2 | 10/2011 | Prill et al. | |
| 8,342,970 | B2 | 1/2013 | Altimas et al. | |
| 2002/0129945 | A1 | 9/2002 | Brewer et al. | |
| 2006/0243493 | A1 * | 11/2006 | El-Rayes | E21B 4/02 175/107 |
| 2007/0251729 | A1 * | 11/2007 | Sand | E21B 4/00 175/107 |
| 2009/0275415 | A1 | 11/2009 | Prill et al. | |
| 2010/0190561 | A1 | 7/2010 | Falgout, Jr. et al. | |

FOREIGN PATENT DOCUMENTS

| | | | |
|---|---|---|---|
| RU | 2162520 | C1 | 1/2001 |
| RU | 2236583 | C1 | 9/2004 |
| RU | 2239042 | C1 | 10/2004 |
| RU | 2401931 | C1 | 10/2010 |

OTHER PUBLICATIONS

First Office Action in counterpart Canadian Appl. 2,805,990, dated Jul. 31, 2014.

Decision on Grant in counterpart Russian Appl. 2013107896, dated Mar. 14, 2014.

First Office Action in U.S. Appl. No. 13/411,535, mailed Jul. 8, 2014.

Reply to First Office Action in U.S. Appl. No. 13/411,535, filed Sep. 24, 2014.

Patent Examination Report No. 1 in counterpart Australian Appl. 2014215980, dated Jul. 9, 2015.

Office Action in counterpart Candian Application 2,860,408, dated Aug. 24, 2015.

Copending U.S. Appl. No. 13/411,535, filed Mar. 3, 2012.

COMPUTALOG Drilling Services, "6-3/4" Oil Lube—SDB Series," dated Oct. 31, 2005.

Second Office Action in counterpart Candian Application 2,860,408, dated May 12, 2016, 4-pgs.

* cited by examiner

WIRED OR PORTED TRANSMISSION SHAFT AND UNIVERSAL JOINTS FOR DOWNHOLE DRILLING MOTOR

BACKGROUND

In borehole geophysics, a wide range of parametric borehole measurements can be made, including chemical and physical properties of the formation penetrated by the borehole, as well as properties of the borehole and material therein. Measurements are also made to determine the path of the borehole during drilling to steer the drilling operation or after drilling to plan details of the borehole. To measure parameters of interest as a function of depth within the borehole, a drill string can convey one or more logging-while-drilling (LWD) or measurement-while-drilling (MWD) sensors along the borehole so measurements can be made with the sensors while the borehole is being drilled.

As shown in FIG. 1A, a drill string 30 deploys in a borehole 12 from a drilling rig 20 and has a bottom hole assembly 40 disposed thereon. The rig 20 has draw works and other systems to control the drill string 30 as it advances and has pumps (not shown) that circulate drilling fluid or mud through the drill string 30. The bottom hole assembly 40 has an electronics section 50, a mud motor 60, and an instrument section 70. Drilling fluid flows from the drill string 30 and through the electronics section 50 to a rotor-stator element in the mud motor 60. Powered by the pumped fluid, the motor 60 imparts torque to the drill bit 34 to rotate the bit 34 and advance the borehole 12. The drilling fluid exits through the drill bit 34 and returns to the surface via the borehole annulus. The circulating drilling fluid removes drill bit cuttings from the borehole 12, controls pressure within the borehole 12, and cools the drill bit 34.

Surface equipment 22 having an uphole telemetry unit (not shown) can obtain sensor responses from one or more sensors in the assembly's instrument section 70. When combined with depth data, the sensor responses can form a log of one or more parameters of interest. Typically, the surface equipment 22 and electronics section 50 transfer data using telemetry systems known in the art, including mud pulse, acoustic, and electromagnetic systems.

Shown in more detail in FIG. 1B, the electronics section 50 couples to the drill string 30 with a connector 32. The electronic section 50 contains an electronics sonde 52 and allows for mud flow therethrough. The sonde 52 includes a downhole telemetry unit 58, a power supply 54, and various sensors 56. Connectors 42/44 couple the mud motor 60 to the electronics section 50, and the connector 42 has a telemetry terminus that electrically connects to elements in the sonde 52.

Mud flows from the drill string 30, through the electronic section 50, through the connectors 42/44, and to the mud motor 50, which has a rotor 64 and a stator 62. The downhole flowing drilling fluid rotates the rotor 64 within the stator 62. In turn, the rotor 64 connects by a flex shaft 66 to a drive shaft or mandrel 72 supported by bearings 68. As it rotates, the flex shaft 66 transmits power from the rotor 64 to the drive shaft 72.

Disposed below the mud motor 60, the instrument section 70 has one or more sensors 74 and electronics 76 to control the sensors 74. A power supply 78, such as a battery, can power the sensors 74 and electronics 76 if power is not supplied from sources above the mud motor 60. The drill bit (34; FIG. 1A) couples to a bit box 36, and the one or more sensors 74 are placed as near to the drill bit (34) as possible for better measurements. Sensor responses are transferred from the sensors 74 to the downhole telemetry unit 58 disposed above the mud motor 60. In turn, the sensor responses are telemetered uphole by the unit 58 to the surface, using mud pulse, electromagnetic, or acoustic telemetry.

Because the instrument section 70 is disposed in the bottom hole assembly 40 below the mud motor 60, the rotational nature of the mud motor 60 presents obstacles for connecting to the downhole sensors 74. As shown, the sensors 74 can be hard wired to the electronics section 50 using conductors 46 disposed within the rotating elements of the mud motor 60. In particular, the conductors 46 connect to the sensor 74 and electronics 76 at a lower terminus 48*a* and extend up through the drive shaft 72, flex shaft 66, and rotor 64. Eventually, the conductors 46 terminate at an upper terminus 48*b* within the mud motor connector 44. As with the lower terminus, this upper terminus 48*b* rotates as do the conductors 46.

Running conductors 46 through the flex shaft 66 creates difficulties with sealing and can be expensive to implement. FIG. 2 shows a prior art arrangement for hard wiring through a transmission section of a mud motor 60 between downhole components (sensors, power supply, electronics, etc.) and uphole components (processor, telemetry unit, etc.). The transmission section has a flex shaft 66 disposed in a housing and coupled between the rotor 64 and the drive shaft or mandrel 72. The flex shaft 66 connects the motor output from the rotor 64 to the drive shaft 72, which is supported by bearings 68. The flex shaft 66 has a reduced cross-section so it can flex laterally while maintaining longitudinal and torsional rigidity to transmit rotation from the mud motor 60 to the drill bit (not shown). A central bore 67 in the flex shaft 66 provides a clear space to accommodate the conductors 46.

The flex shaft 66 is elongated and has downhole and uphole adapters 69*a-b* disposed thereon. The shaft 66 and adapters 69*a-b* each define the bore 67 so the conductors 46 used for power and/or communications can pass through them. The adapters 69*a-b* typically shrink or press with an interference fit to the ends of the shaft 66.

Down flowing drilling fluid from the stator 62 and rotor 64 passes in the annular space around the shaft 66 and adapters 69*a-b*. The shrink fitting of the adapters 69*a-b* to the shaft 66 creates a fluid tight seal that prevents the drilling fluid from passing into the shaft's bore 67 at the adapters 69*a-b*, which could damage the conductors 46. A port 69*c* toward the downhole adapter 69*a* allows the drilling fluid to enter a central bore 73 of the drive shaft 72 so the fluid can be conveyed to the drill bit (not shown).

The flex shaft 66 has to be long enough to convert the orbital motion of the rotor 64 into purely rotational motion for the drive shaft 72 while being able to handle the required torque, stresses, and the like. Moreover, the flex shaft 66 has to be composed of a strong material having low stiffness in order to reduce bending stresses (for a given bending moment) and also to minimize the side loads placed on the surrounding radial bearings 68. For this reasons, the elongated flex shaft 66 is typically composed of titanium and can be as long as 4.5 to 5 feet. Thus, the shaft 66 can be quite expensive and complex to manufacture. Moreover, the end adaptors 69*a-b* shrink fit onto ends of the shaft 66 to create a fluid tight seal to keep drilling fluid out of the internal bore 67 in the shaft 66. Although the shrink fit of the adapters 69*a-b* avoids sealing issues, this arrangement can be expensive and complex to manufacture and assemble.

Other prior art mud motors have transmission sections with different configurations than disclosed above with reference to the fixed flex shaft. For example, FIGS. 3A-3C shows a prior art mud motor 60 that uses two drivelines 80 and 90 to facilitate a short bit-to-bend length. This mud motor 60 is similar to the 6.75-in. Oil Lube—SDB series mud motor available from Computalog Drilling Services, a predecessor to the assignee of the present application.

A top driveline 80 has a solid transmission shaft 82 that converts the rotor's orbital motion into pure rotational motion. One end of the solid transmission shaft 82 connects to the rotor 64 with an adapter 69*b* and a universal joint 84*b*, and the opposing the end of the drive shaft 82 connects to a bottom driveline 90 with a universal joint 84*a*. Because the solid transmission shaft 82 is exposed to drilling fluid inside the surrounding housing 65, both of the universal joints 84*a-b* are sealed with rubber seal boots to keep lubricating oil in and to keep drilling fluid out of the joints 84*a-b*.

During operation, the drilling mud used to operate the positive displacement motor 60 flows from the stator 62 and the rotor 64 and into the annular space between the motor housing 65 and solid transmission shaft 82. From this upper section, all of the drilling fluid is then directed into an adapter's ports 86 that lead to the bottom driveline 90.

In the bottom driveline 90, the fluid flows into a central bore 93 of a piston mandrel 92*b*. The fluid then flows through a bore 93 of a second transmission shaft 92*a* and into a bore 73 of a bearing mandrel 72, from which the fluid can lead to a drill bit (not shown). Thus, this prior art motor 60 uses the bores 93 in the piston mandrel 92*b* and second transmission shaft 92*a* and the bore 73 in the bearing mandrel 72 for directing drilling fluid flow to the drill bit.

Looking at the arrangement for this fluid flow bore 93 of the bottom driveline 90 in more detail, the top end of the second transmission shaft 92*a* is coupled to the piston mandrel 92*b* with a universal joint 94*b*, and the bottom end of the second transmission shaft 92*a* is coupled to the bearing mandrel 72 with a universal joint 94*a*. This second transmission shaft 92*a* allows the motor housing to be bent to facilitate directional drilling. Seal boots are not necessary here at the joints 94*a-b* because the bottom driveline 90 is contained in a sealed oil chamber 67.

To prevent drilling fluid from entering the oil chamber 67 via the central bore 93, seal journals 96*a-b* are threaded into each drive adapter of the joints 94*a-b* with an O-ring to seal the threads. Each end of the drive shaft bore 93 inserts onto the journals 96*a-b* with an internal O-ring to create a seal. The journals 96*a-b* remain fixed to the adaptors for the joints 94*a-b*, while the second transmission shaft 92*a* can articulate to an extent. The seals between the shaft's bore 93 and the journals 96*a-b* are located at a center of rotation of the joints 94*a-b* to reduce the geometrical changes at the sealing site. The ends of the shaft's bore 93 are also machined at certain angles to allow the joints 94*a-b* to articulate a small amount when the motor 60 is bent so the second transmission shaft 92*a* can avoid contacting the journals 96*a-b*.

The fixed journals 96*a-b* for the joints 94*a-b* are suited for sealing fluid passage to the drill bit because the transmission section has two transmission shafts 82 and 92*a* to reduce the amount of articulation at each joint 84*a-b* and 94*a-b*. As shown in FIG. 3D, for example, the motor 60 is shown with a 2-degree bend in which the two transmission shafts 82 and 92*a* compensate for eccentricity in the power section and for bend in the housing. In particular, the joints 84*a-b* of the first transmission shaft 82 compensate for the eccentricity of the power section (given here as angles $\Gamma$ and $\Omega$ of 0.58-degrees). The joints 94*a-b* of the second transmission shaft 92*a* compensate for the bend in the housing (given here as angles $\beta$ of 0.80-degrees and $\alpha$ of 1.20-degrees). At these lower bend angles, the fixed journals 96*a-b* inside the second transmission shaft 92*a* can seal close to the center of rotation of the joints 94*a-b* so the sealing profile will change the least as the joints 94*a-b* articulate.

As can be seen above, a bore in a shaft of a prior art mud motor can be conventionally used to convey drilling fluids to a drill bit as in the arrangement of FIGS. 3A-3D. Alternatively, a bore in a shaft of a prior art mud motor can be used for passage of wires, as in the arrangement of FIG. 2. However, arranging a motor to achieve either one of these purposes of ported or wired communication through a shaft while transferring motor motion to rotational motion and still allowing for bending during use requires a mud motor to be considerably longer and more complex than desired for downhole operations.

The subject matter of the present disclosure is directed to overcoming, or at least reducing the effects of, one or more of the problems set forth above.

SUMMARY

A bottom hole assembly for a drill string has a mud motor, a mandrel, and a transmission section. The mud motor has a rotor and a stator, and the rotor defines a rotor bore for passage of drilling fluid and/or one or more conductors, which may be contained in a conductor conduit. The mandrel has a bore for passage of the conductors and for drilling fluid, and rotation of the mandrel rotates a drill bit.

Drilling fluid pumped down the drill string passes through the mud motor and drives the rotor within the stator. The drilling fluid passes the transmission section and enters a port in the mandrel's bore so the drilling fluid can be delivered to the drill bit on the mandrel.

A shaft in the transmission section has a bore and converts the drive at the mud motor to rotational motion at the mandrel. The shaft couples at a first end to the rotor with a first universal joint and couples at a second end to the mandrel with a second universal joint. First and second inner beams dispose in the shaft's bore at the joints. The shaft can be composed of alloy steel, while the inner beams can be composed of titanium.

The first and second inner beams can seal communication of the first bore of the rotor with the second bore of the mandrel through the third bore of the shaft. In particular, the first inner beam disposed at the first end of the shaft defines a first internal passage and has first proximal and distal ends. The first distal end seals communication of the first beam's internal passage with the first bore of the rotor, and the first proximal end seals communication of the first beam's internal passage with the third bore of the shaft and with the second bore of the mandrel. In like manner, the second inner beam disposed at the second end of the shaft defines a second internal passage and has second proximal and distal ends. The second distal end seals communication of the second beam's internal passage with the second bore of the mandrel, and the second proximal end seals communication of the second beam's internal passage with the third bore of the shaft and with the first bore of the rotor.

In one arrangement, the distal end (its upstream end) of the first inner beam is sealed in a first passage of the first universal joint, and the proximal end (its downstream end) is sealed at some point in the third bore of the shaft. Likewise, the second inner beam has the distal end (its downstream end) sealed in a second passage of the second universal joint and has the proximal end (its upstream end) sealed at some point in the third bore of the shaft. In one particular arrangement, the distal ends of these inner beams can have cap ends fixedly sealed in the adapter's passages, while the proximal ends of these inner beams can have jointed ends pivotably sealed in the third bore of the shaft. Additionally, these inner beams can define a neck of reduced wall thickness between the ends to allow for some flexure.

For their part, the universal joints can each have a joint member coupled to the rotor and can have a socket receiving an end of the shaft therein. At least one bearing can dispose in a bearing pocket in the end of the shaft, and at least one bearing slot in the socket can receive the at least one bearing. To hold the bearing, a retaining ring can dispose about the end of the shaft adjacent the socket in the joint member. Alternatively, the ends of the shaft can have integral projections formed thereon that are received in bearing slots of the socket.

The assembly can have a flow control for controlling at least some fluid flow through the assembly between first and second routes. Such a flow control can be valve or other flow restriction or fluid release element, and the flow control can be used to direct the trajectory of the borehole during drilling. The first route passes between the rotor and the stator, outside the shaft, and into the second bore of the mandrel. By contrast, the second route passes through the first bore of the rotor, through the third bore of the shaft, and into the second bore of the mandrel.

The mandrel below the motor section can have an electronic device, such as a sensor, associated therewith. The conductors passing through the transmission section can electrically couple to the electronic device and pass from the bore of the mandrel, through the shaft's bore, and to the bore of the rotor. For example, the conductors can pass from a sensor disposed with the mandrel to a sonde disposed above the mud motor. The sensor can be a gamma radiation detector, a neutron detector, an inclinometer, an accelerometer, an acoustic sensor, an electromagnetic sensor, a pressure sensor, or a temperature sensor. The conductors can be one or more single strands of wire, a twisted pair, a shielded multi-conductor cable, a coaxial cable, and an optical fiber.

The foregoing summary is not intended to summarize each potential embodiment or every aspect of the present disclosure.

DETAILED DESCRIPTION

Figure 4A:
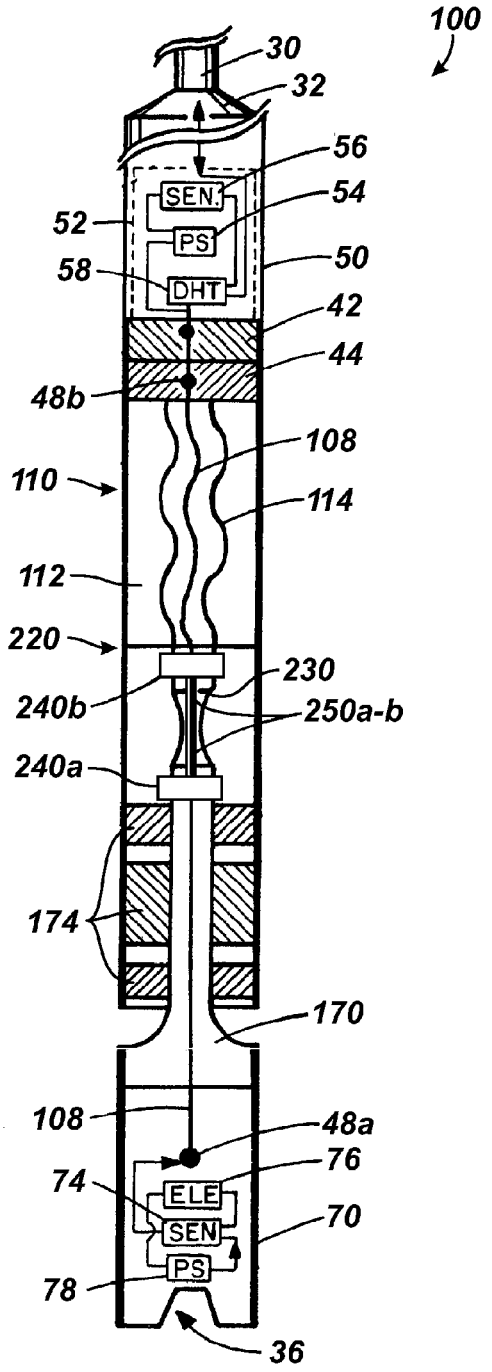
FIG. 4A conceptually illustrates a bottom hole assembly according to the present disclosure.

A bottom hole or downhole assembly 100 according to the present disclosure conceptually illustrated in FIG. 4A connects to a drill string 30 with a connector 32 and deploys in a borehole from a drilling rig (not shown). The bottom hole assembly 100 has an electronics section 50, a motor section 110, a transmission section 220, and an instrument section 70. A drill bit (not shown) disposes at the bit box connection 36 on the end of the assembly 100 so the borehole can be drilled during operation.

The electronics section 50 is similar to that described previously and includes an electronics sonde 52 having a power supply 54, sensors 56, and a downhole telemetry unit 58. Disposed below the electronics section 50, the motor section 110 includes a drilling motor, which can be a mud motor, a positive displacement motor, a Moineau motor, a Moyno® motor, a turbine type motor, or other type of downhole motor. (MOYNO is a trademark of R&M Energy Systems.)

Currently shown as a positive displacement motor, the motor section 110 has a stator 112 and a rotor 114. Drilling fluid from the drill string 30 flows through a downhole telemetry connector 42 and through a mud motor connector 44 to the mud motor section 110. Here, the downhole flowing drilling fluid drives the rotor 114 within the stator 112. In turn, the rotor 114 connects by a transmission shaft 230 to a mandrel or drive shaft 170 supported by bearings 174. As it rotates, the transmission shaft 230 transmits drive power from the rotor 114 to the drive shaft 170.

The instrument section 70 is disposed below the transmission section 220. The instrument section 70 is also similar to that described previously and includes one or more sensors 74, an electronics package 76, and an optional power supply 78. (Because a conductor conduit 108 has conductors that can provide electrical power, the power source 78 may not be required within the instrument section 70.) The one or more sensors 74 can be any type of sensing or measuring device used in geophysical borehole measurements, including gamma radiation detectors, neutron detectors, inclinometers, accelerometers, acoustic sensors, electromagnetic sensors, pressure sensors, temperature sensors, and the like.

The one or more sensors 74 respond to parameters of interest during drilling. For example, the sensors 74 can obtain logging and drilling parameters, such as direction, RPM, weight/torque on bit and the like, as required for the particular drilling scenario. In turn, sensor responses are transferred from the sensors 74 to the downhole telemetry unit 58 disposed above the mud motor section 110 using one or more conductors, which can be contained in a conductor conduit 108.

From here, a number of techniques can be used to transmit the sensor responses across the connectors 42/44, including techniques disclosed in U.S. Pat. No. 7,303,007, which is incorporated herein by reference in its entirety. In turn, the sensor responses are telemetered uphole by the unit 58 to the surface, using mud pulse, electromagnetic, or acoustic telemetry. Conversely, information can be transferred from the surface through an uphole telemetry unit and received by the downhole telemetry unit 58. This "down-link" information can be used to control the instrument section 70 or to control the direction in which the borehole is being advanced.

Because the instrument section 70 is disposed in the bottom hole assembly 100 below the mud motor section 110, the rotational nature of the mud motor section 110 presents obstacles for connecting the telemetry unit 58, power supply 54, and the like to the downhole sensors 74 below the mud motor section 110.

To communicate sensor response, convey power, and the like, the conductor conduit 108 disposes within the rotating elements of the bottom hole assembly 100 and has one or more conductors that connect the sonde 52 to the instrument section 70 and to other components. As shown in FIG. 4A, for example, the sensor 74 and electronics 76 electrically connect to a lower terminus 48*a* of conductors in the conduit 108. These conductors in the conduit 108 can be single strands of wire, twisted pairs, shielded multi-conductor cable, coaxial cable, optical fiber, and the like.

The conductor conduit 108 extends from the lower terminus 48*a* and passes through the mandrel or drive shaft 170, the transmission section 220, and the motor section's rotor 114. Eventually, the conductor conduit 108 terminates at an upper terminus 48*b* within the mud motor connector 44. As with the lower terminus, this upper terminus 48*b* rotates as does the conductor conduit 108. Various fixtures, wire tensioning assemblies, rotary electrical connections, and the like (not shown) can be used to support the conductor conduit 108 and their passage through the bottom hole assembly 100.

As noted previously and shown in FIG. 4A, the transmission section 220 has the transmission shaft 230 coupled between upper and lower universal joints 240*a-b*. The transmission shaft 230 and the universal joints 240*a-b* interconnect the motor section's rotor 114 to the drive shaft 170 and convert the orbital motion at the rotor 114 to rotational motion at the drive shaft 170. The conductor conduit 108 also passes through the transmission shaft 230 and the universal joints 240*a-b* as they interconnect the downhole sensors 74 to the uphole components (e.g., telemetry unit 58, power supply 54, etc.).

Figure 4B:
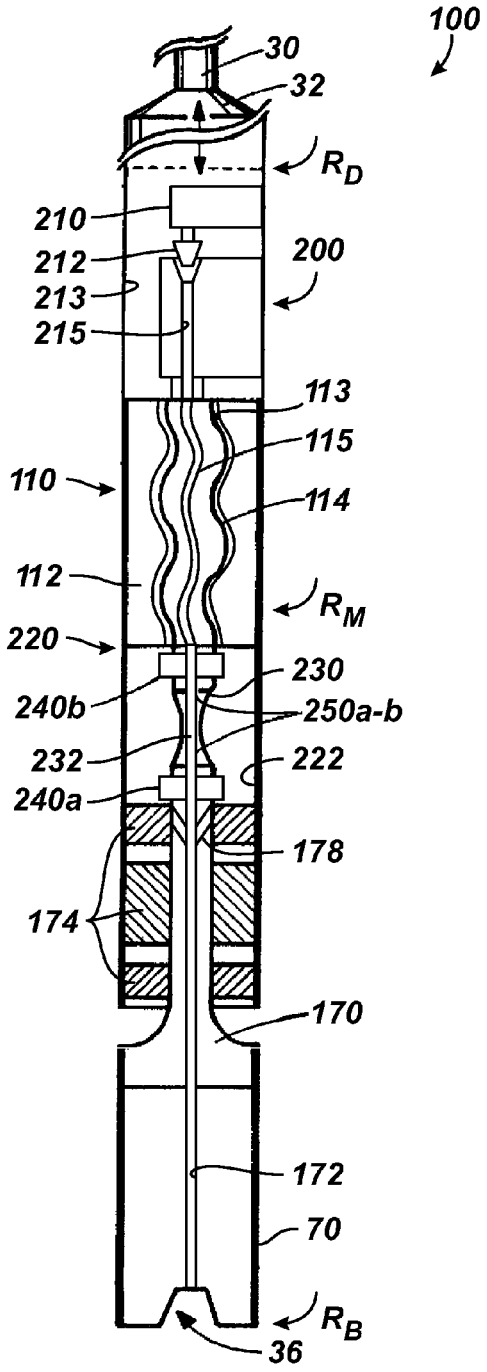
FIG. 4B conceptually illustrates another bottom hole assembly according to the present disclosure.

FIG. 4B conceptually illustrates another bottom hole assembly 100 according to the present disclosure. Rather than or in addition to communicating a conductor conduit (not shown), the transmission section 220 communicates fluid to achieve steering during drilling. Details related to using mud flow in a mud motor 110 and transmission section 220 to steer drilling are disclosed in U.S. Pat. No. 7,766,098, which is incorporated herein by reference.

During operation, the drill string 30 may or may not be rotating at a rotational rate $R_D$. In typical fashion, the drill string 30 is connected to the housing (or "stator") 112 of the motor 110. As drilling fluid is pumped through the motor 110 in the space 113 between the rotor 114 and stator 112, the rotor 114 is driven to rotate relative to the stator 112 at a rotational rate $R_M$. The transmission shaft 230 of the motor 110 transfers the rotor's rotation to the mandrel 170 and eventually the drill bit (not shown). In the end, the drill bit rotation speed $R_B$ can be the sum of the drillstring rotation rate $R_D$ (if present) and the motor rotation rate $R_M$.

The system 100 can use periodic variation in the rotational speed of the drill bit in defining a trajectory of an advancing borehole during drilling. As discussed below, the rotational speed of the drill bit is periodically varied by periodically varying the rotation of the motor 110, which is varied by varying drilling fluid flow through the mud motor 110. This is accomplished with a flow control element 200 that can act as a fluid flow restriction or fluid release element. The flow control element 200 can be disposed within the assembly 100, as shown, or can be disposed elsewhere.

As disclosed in U.S. Pat. No. 7,766,098, for example, the bottom hole assembly 100 as configured in FIG. 4B can steer the direction of a borehole advanced by the cutting action of the drill bit by periodically varying the rotational speed of the drill bit. The motor 110 is disposed in the bent housing subsection and is operationally connected to the drill string 30 and to the drill bit. The rotational speed of the drill bit is periodically varied by periodic varying the rotational speed of the motor 110 and/or by periodic varying the rotational speed of the drill string 30. Periodic bit speed rotation results in preferential cutting of material from a predetermined arc of the borehole wall which, in turn, results in borehole deviation. Both the drill string 30 and the drill motor 110 can be rotated simultaneously during straight and deviated borehole drilling.

During drilling, the mud motor 110 rotates the drill bit when the drilling fluid pumped down the drillstring 30 passes in the space 113 between the rotor 114 and stator 112, as discussed above. The drilling fluid exiting the space 113 enters the surrounding chamber 222 of the transmission section 220 around the transmission shaft 230 and universal joints 240*a-b*. The fluid then enters via ports 178 in the mandrel 170 so the fluid can pass through the fluid passage 172 in the mandrel 170 and eventually pass to the drill bit for removing cuttings, cooling the bit, and the like.

This is the standard path or route of the drilling fluid during operation of the mud motor 110; however, the assembly 100 has an alternative path or route for the drilling fluid through a central passage 115 in the rotor 114 and a central passage 232 in the transmission shaft 230. The drilling fluid passing through this alternate route can likewise pass into the fluid passage 172 in the mandrel 170 and eventually to the drill bit, but the diverted fluid does not add to the motor's operation because the fluid passes instead through the central passage 115 in the rotor 114.

To control which route the drilling fluid takes during operations, the flow control element 200 has a valve member 212 controlled by an actuator 210, which can be connected to other control components (not shown) of the assembly 100. The actuator 210 is located within the path for the drilling fluid through the downhole assembly 100. During drilling operations, the actuator 210 can control the valve member 212 to move between a closed position in which drilling fluid cannot enter a conduit 215 and an open position in which drilling fluid can enter the conduit 215.

When the valve member 212 is closed, drilling fluid is pumped through the space 113 between the stator 112 and the rotor 114 so that the rotor 114 rotates. When the valve member 212 is open, however, at least some of the drilling fluid can enter the conduit 215 and pass through the central passage 115 in the rotor 114 to bypass the motor 110.

Accordingly, opening and closing of the valve member 212 affects the rate of rotation of the rotor 114 and can be used to control the drilling trajectory.

As noted above, the transmission section 220 provides a single transmission shaft 230 with universal joints 240*a-b* to transmit the orbital motion of the rotor 114 to pure rotation at the mandrel 170, while the transmission sections 220 allows for fluid and/or conductors to pass from the rotor 114 to the mandrel 170. One particular way to provide a conduit for fluid and/or conductors through a transmission section of a mud motor is disclosed in U.S. application Ser. No. 13/411,535, filed 3 Mar. 2012, which is assigned to the Assignee of the present disclosure and is incorporated herein by reference in its entirety. In accordance with the present disclosure, FIGS. 5A through 9 show another way to provide a conduit for fluid and/or conductors through the disclosed transmission section 220 to achieve the various purposes disclosed herein for a mud motor.

Figure 5A:
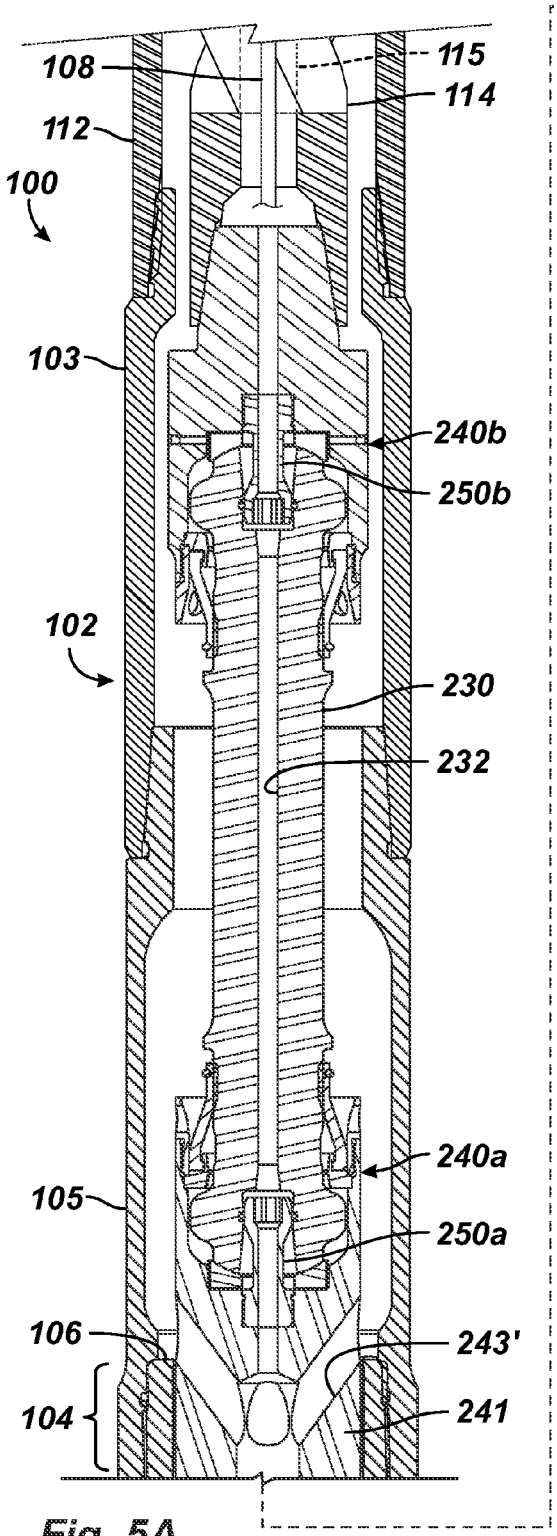
FIG. 5A-5B show portion of a bottom hole assembly having a transmission section according to the present disclosure for passage of conductors and/or flow therethrough.
Figure 5B:
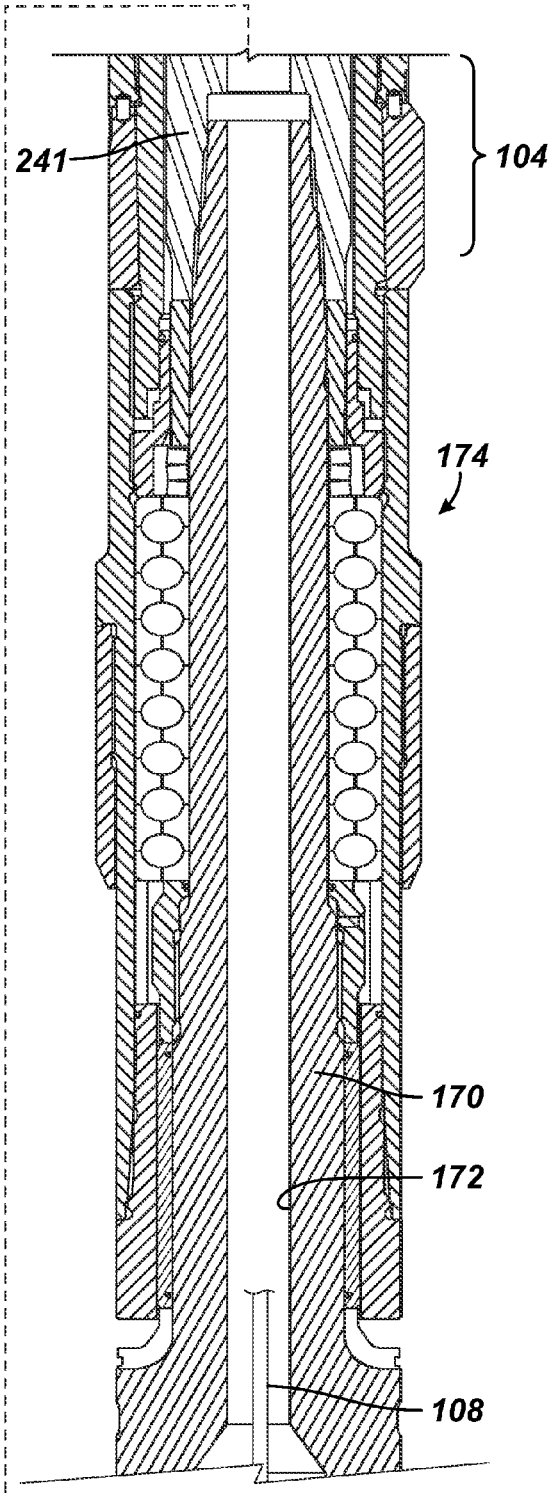

Turning first to FIGS. 5A-5B, the housing 102 at the transmission section 220 has a number of interconnected housing components to facilitate assembly and provide a certain bend. For example, the housing 102 has a stator housing adapter 103 that couples to the stator 112. A transmission housing 105 connects between housing 102 and an adjustable assembly 104. This adjustable assembly 104 provides the drilling motor with a certain bend capability.

Downhole flowing drilling fluid passing between the rotor 114 and the stator 112 causes the rotor 114 to orbit (rotate) within the stator 112. In turn, the transmission shaft 230 transfers the orbital motion at the rotor 114 to rotational motion at the mandrel or drive shaft 170. At the downhole end of the assembly 100, a bearing assembly 174 provides radial and axial support of the drive shaft 170. The bearing assembly 174 can have one set of bearings for axial support and another set of bearings for radial support. The bearing assembly 174 can have conventional ball bearings, journal bearings, PDC bearings, or the like. In turn, the drive shaft 170 couples to the other components of the bottom hole assembly 100 including the drill bit (not shown).

After the drilling fluid passes the rotor 114 and the stator 112, the downward flowing fluid passes in the annular space of the housing 102 around the transmission shaft 230 and the universal joints 240*a-b*. A flow restrictor 106 in the transmission housing 105 disposed around an end connector 241 at the downhole joint 240*a* then restricts flow between the transmission section 220 and the bearing assembly 174. As a result, the drilling fluid enters ports 243' that let the drilling fluid from around the transmission shaft 230 to pass into the bore 172 of the drive shaft 170, where the fluid can continue on to the drill bit (not shown).

Figure 6:
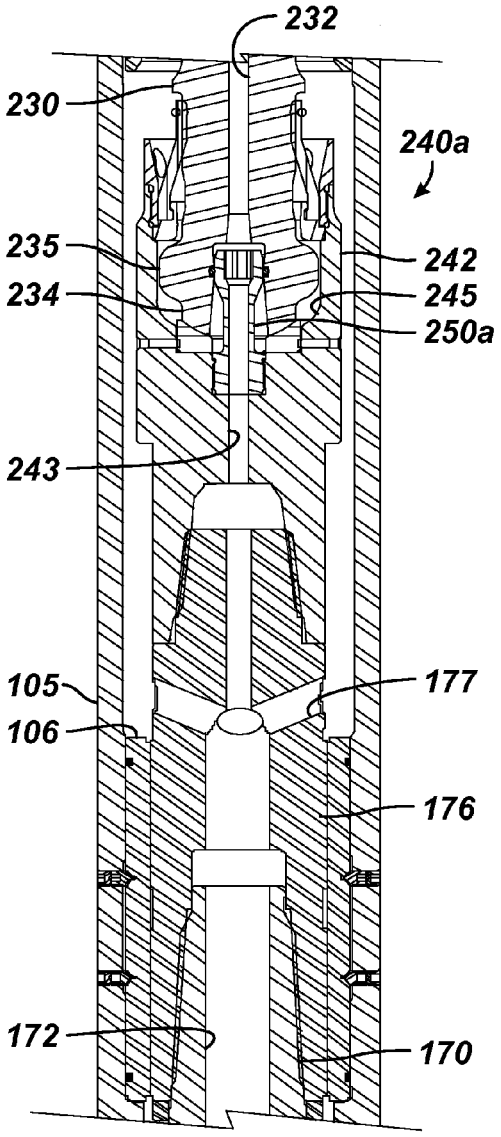
FIG. 6 shows a portion of the disclosed transmission section with an alternative adapter arrangement.

Rather than the integrated end connector 241 on the lower universal joint 240*a* as shown in FIG. 5B, a separate end connector 176 as shown in FIG. 6 can connect the drive shaft 170 to the lower universal joint 240*a*. This separate end connector 176 has ports 177 that let the drilling fluid from around the transmission shaft 230 to pass into the drive shaft 170, where the fluid can continue on to the drill bit (not shown).

As can be seen in FIGS. 5A-5B, the assembly 100 of the present disclosure has only one transmission shaft 230 to transform the rotor's orbital motion to rotational motion and to compensate for the bend of the motor 110. Additionally, the transmission shaft 230 has an internal bore 232 to allow for the conductor conduit 108 to run through and/or to allow for flow of drilling fluid therethrough when varying the motor speed.

For illustrative purposes, the entire conduit 108 is not illustrated, as only uphole and downhole portions are shown. Overall, the conductor conduit 108 passes from the uphole components (e.g., telemetry unit, power supply, etc.); through the passage or bore 115 in the rotor 114; through the arrangement of the upper universal joint 240*b*, the transmission shaft 230, and the lower universal joint 240*a*; and eventually to the drive mandrel or shaft 170. At this point, the conductor conduit 108 can continue through the bore 172 of the drive shaft 170 to downhole components (e.g., sensors, electronics, etc.).

In a similar fashion, any flow of drilling fluid diverted during control of the mud motor 110 into the bore 115 of the rotor 114 can pass from the bore 115 in the rotor 114; through the arrangement of the upper universal joint 240*b*, the transmission shaft 230, and the lower universal joint 240*a*; to the drive mandrel 170; and eventually to the drill bit (not shown). As will be described in more detail below, the transmission section 220 uses two inner beams 250*a-b* at the articulating joints 240*a-b* of the section's transmission shaft 230 to protect the joints 240*a-b* and to protect the passage of the conductors and/or diverted fluid flow through the transmission shaft 230.

Figure 3A:
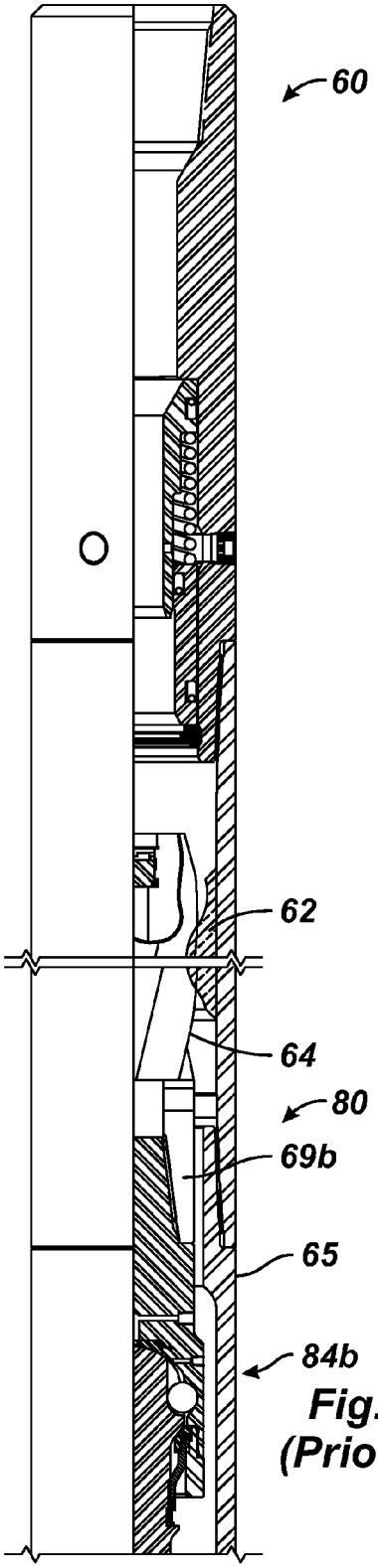
Fig. 3A (Prior Art)
FIGS. 3A-3C shows another prior art mud motor having a shaft for passing fluid therethrough to a drill bit.
Figure 3B:
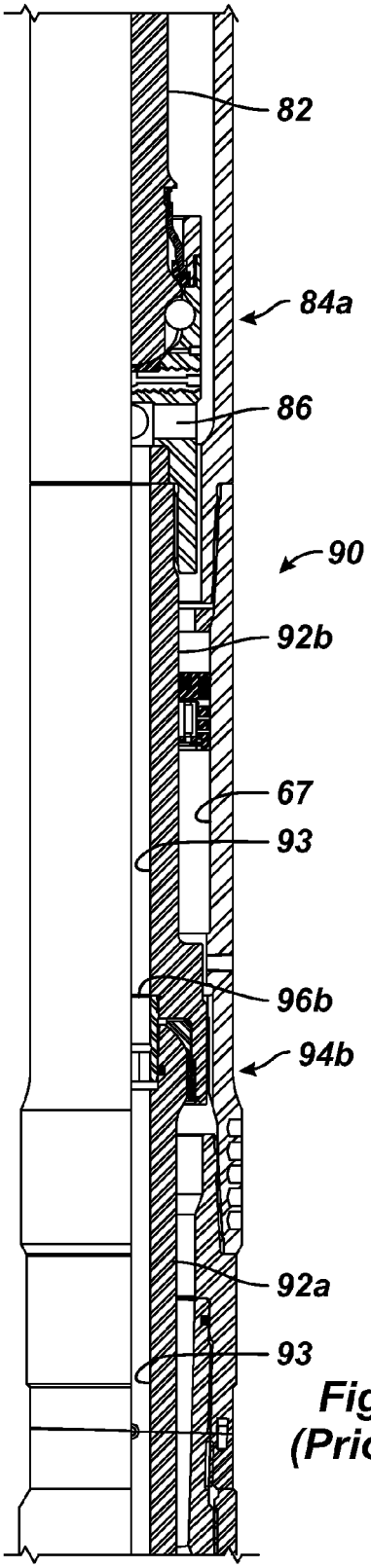
Fig. 3B (Prior Art)
Figure 3C:
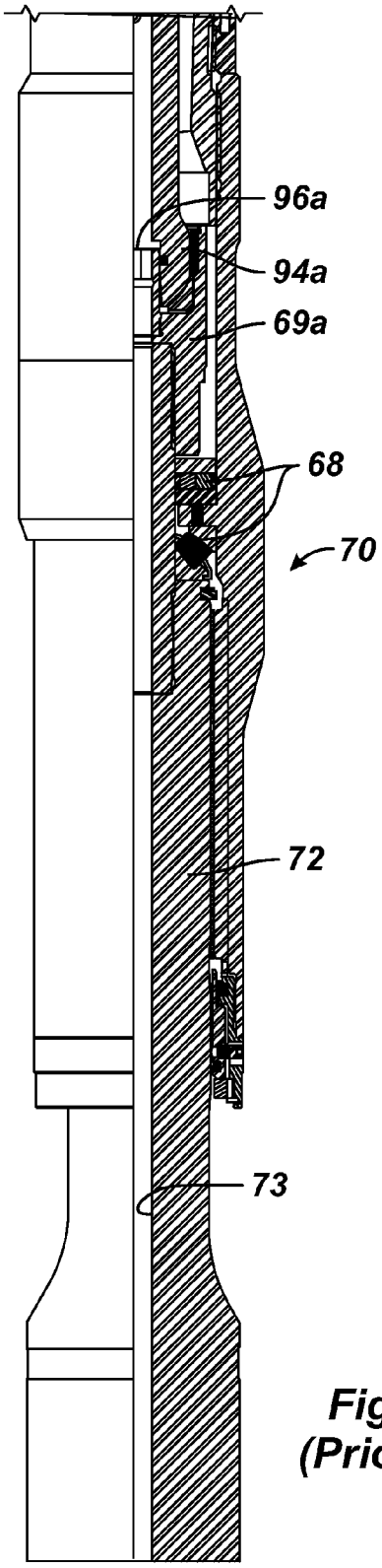
Fig. 3C (Prior Art)
Figure 3D:
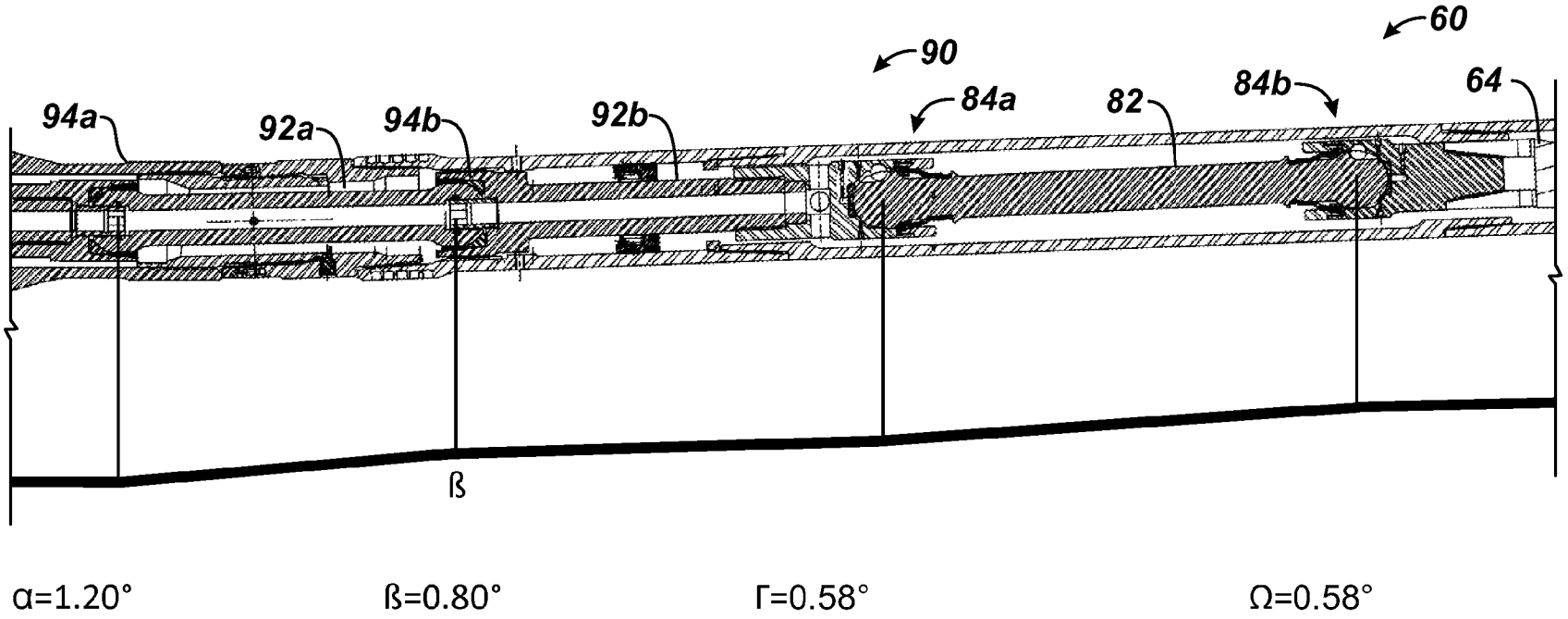
Fig. 3D (Prior Art)
FIG. 3D shows the prior art mud motor with a 2-degree bend.
Figure 5C:
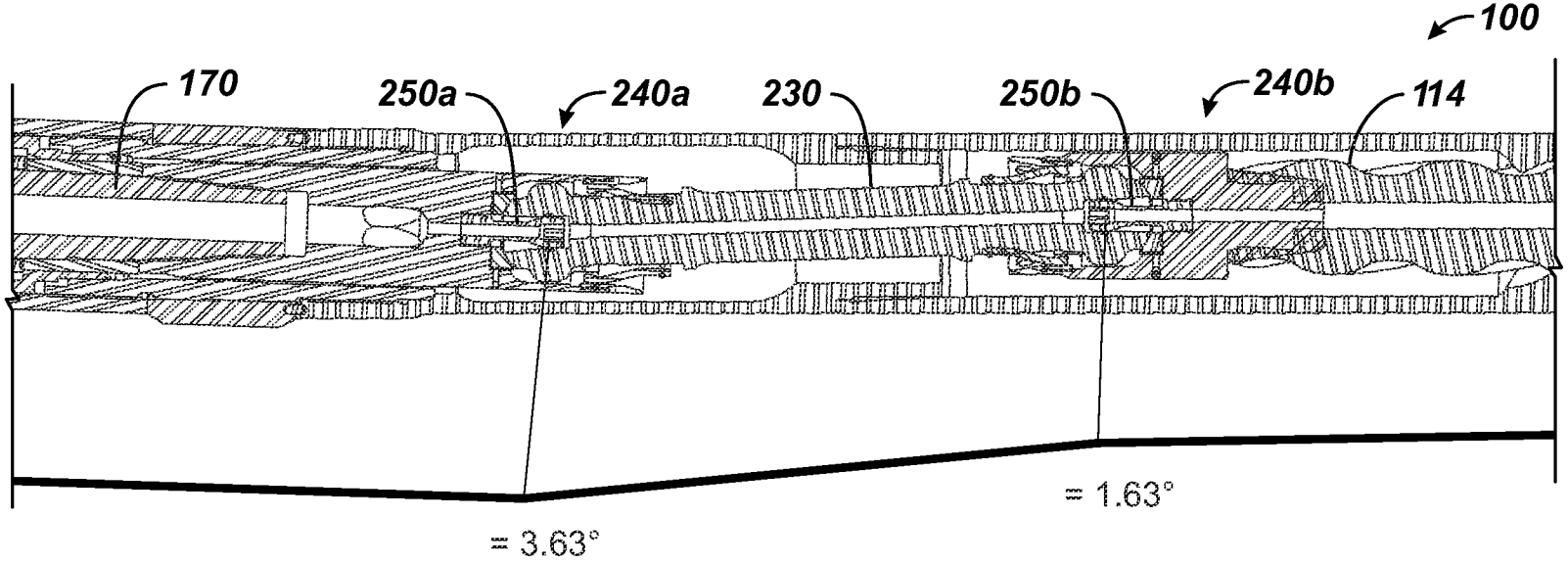
FIG. 5C shows portion of the bottom hole assembly with a 2-degree bend.

As shown in FIG. 5C, portion of the bottom hole assembly is shown with a 2-degree bend. As can be seen, the sole transmission shaft 230 compensates for eccentricity in the power section and for bend in the housing 102 and achieves this over a much shorter length (e.g., at least half of the length) of the multiple shaft motor available in the prior art (See e.g., FIG. 3D). In particular, the joint 240*b* of the transmission shaft 230 compensates for the eccentricity of the power section (given here as an angle $\Phi$ of 1.63-degrees), and the other joint 240*a* compensates for the bend in the housing (given here as an angle $\Theta$ of 3.63-degrees). To seal at the universal joints 240*a-b* for ported or wired communication, the inner beams 250*a-b* inside the transmission shaft 230 are configured to handle such high bend angles, as described in more detail below.

Figure 7A:
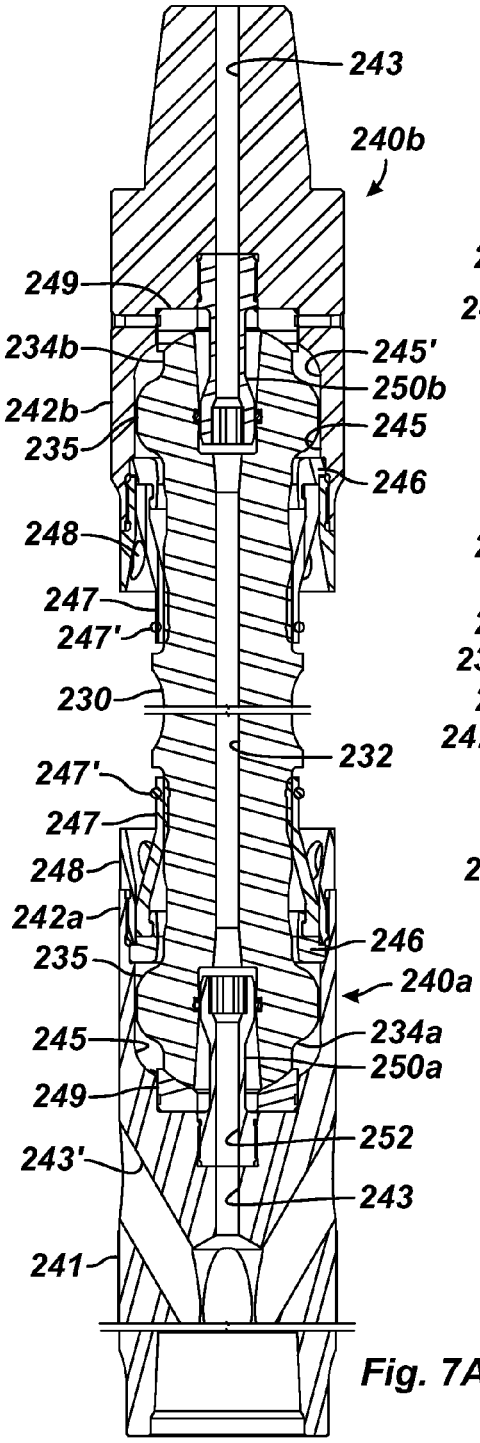
FIG. 7A shows the transmission shaft and universal joints for use in the transmission section of FIGS. 5A-5B.
Figure 7B:
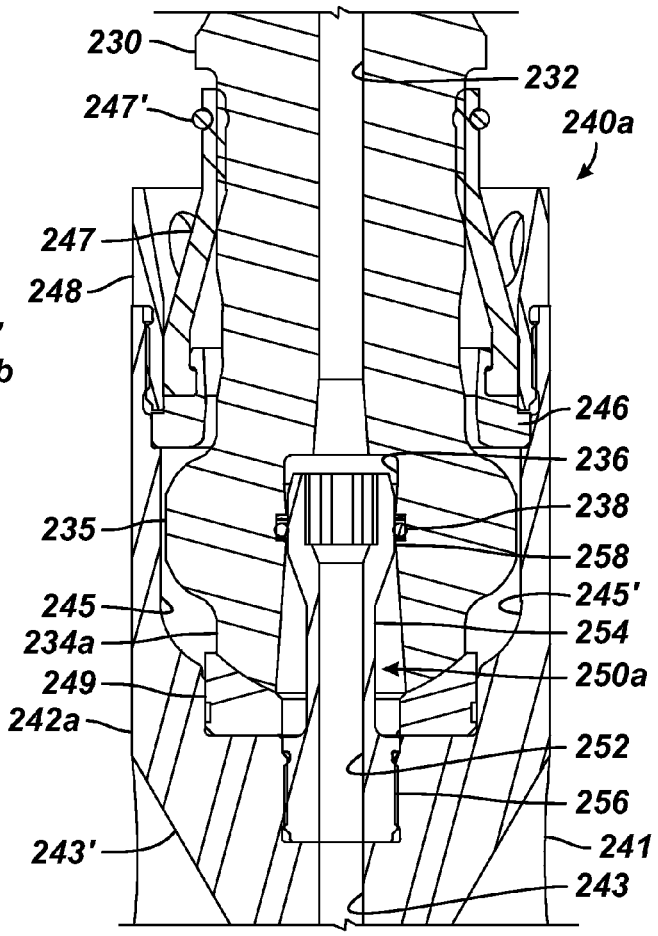
FIG. 7B shows a detail of one of the joints on the transmission shaft of FIG. 8A.
Figure 7C:
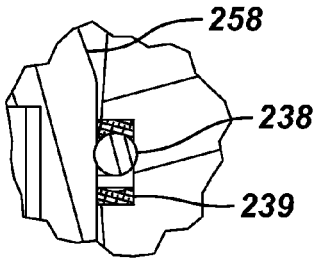
FIG. 7C shows a detail of a seal for the joint of FIG. 7B.

Given the above overview of the transmission section 220 and other features, discussion now turns to FIGS. 7A-7C showing isolated details of the transmission shaft 230 and the universal joints 240*a-b* for use in the transmission section 220 of FIGS. 5A-5B. FIG. 7A shows the shaft 230 and the universal joints 240*a-b* in cross-section, and FIG. 7B shows a detail of one of the universal joints 240*a* on an end of the transmission shaft 230. Finally, FIG. 7C shows a detail of a seal for the joint 240*a* of FIG. 7B.

As best shown in FIG. 7A, the transmission shaft 230 (shown without a conductor conduit (108) passing therethrough) has downhole and uphole ends 234*a-b* coupled to the universal joints 240*a-b*. During rotation, the universal joints 240*a-b* transfer rotation between the rotor (114) and the mandrel or drive shaft (170) coupled respectively to the universal joints 240*a-b*. At the same time, the universal joints 240*a-b* allow the connection with the transmission shaft's ends 234*a-b* to articulate during the rotation. In this way, the transmission shaft 230 can convert the orbital motion at the rotor 114 into purely rotational motion at the mandrel 170.

To convey the conductor conduit (108) from the rotor (114) to the instrument section associated with the mandrel (170) and/or to convey diverted drilling fluid from the rotor's bore (115) to the mandrel's bore (172) during motor control, the transmission shaft 230 defines a through-bore 232. To deal with fluid sealing at the connections of the shaft's ends 234*a-b* to the universal joints 240*a-b*, inner beams 250*a-b* having their own internal passages or bores 252 install in the transmission shaft's bore 232. As described below, the inner beams 250*a-b* help seal passage of the conduit (108) and/or drilling fluid through the connection of the universal joints 240*a-b* to the transmission shaft 230, and the inner beams 250*a-b* flex to compensate for eccentricity of the power section and any bend of the drilling motor.

The universal joints 240*a-b* can take a number of forms. In the present arrangement, for example, the universal joints 240*a-b* include joint members or adapters 242*a-b* having sockets 245 in which the ends 234*a-b* of the shaft 230 position. Thrust seats 249 are provided between the ends 234*a-b* and the sockets 245, and projections 235 on the shaft's ends 234*a-b* dispose in bearing slots 245' in the sockets 245 of the joint adapters 242*a-b*. Retaining split rings 246 dispose about the ends of the shaft 230 adjacent the sockets 245 and connect to the joint adapters 242*a-b*. In addition, seal boots 247 and retainers 247' connect from the split rings 246 to the shaft 230 to keep drilling fluid from entering and to balance pressure for lubrication oil in the joint's reservoir to the internal pressure of the drilling motor. Seal collars 248 then hold the seal assemblies on the joint adapters 242*a-b*.

As described in more below, the inner beams 250*a-b* thread into the joint adaptors 242*a-b* and insert into the shaft's bore 232 with seals to prevent ingress and egress of fluid and to maintain a pressure differential between oil in joint reservoir and the fluid in bore 232. For their part, the joints 240*a-b* for the shaft 230 are filled with oil and use rubber boots and other features noted previously as barriers between the lubricating oil and the drilling fluid. Therefore, the inner beams 250*a-b* help seal passage of the conduit (108) and/or fluid flow through the universal joints 240*a-b*, and the inner beams 250*a-b* flex and/or pivot to compensate for eccentricity of the transmission section 220 and any bend of the drilling motor.

To prepare the transmission section 220, operators mill the bore 232 through the transmission shaft 230. Operators then thread first ends of the inner beams 250*a-b* in the passages 243 of the joint adapters 242*a-b* and then fit the adapters 242*a-b* on the ends 234*a-b* of the shaft 230. As this is done, second ends of the inner beams 250*a-b* install in the ends of the shaft's bore 232 for sealing purposes. Eventually, the various features of boots 247, retainers 247' and 248, and the like are assembled on the universal joints 240*a-b*, and the reservoirs of the joints 240*a-b* are filled with oil.

In later stages of assembly, operators can run the conductor conduit (108) (if used) through the universal joint's adapters 242*a-b*, the bores 252 of the inner beams 250*a-b*, and the shaft's bore 232 and can eventually run the conductor conduit (108) to a point further in the drive mandrel 170. Although not shown, seals can be provided inside the inner beams 250*a-b* (i.e., at the pivot ends 258) to seal against the conductor conduit (108) passing therethrough.

As best shown in the detail of FIG. 7B, each of the inner beams (only 250*a* is shown) has a threaded seal cap end 256 connected by a neck 254 to a jointed or pivotable seal end 258. A passage 252 extends from the one end 256 to the other end 258 through the inner beam 250*a*. The seal cap end 256 threads into a threaded area of the adapter's passage 243, whereas the jointed end 258 inserts into a pivot pocket 236 defined in the shaft's bore 232. The shaft's pivot pocket 236 is machined with a taper to allow for articulation of the jointed end 258 therein.

For this "downstream" inner beam 250*a*, its "downstream" end has the seal cap end 256 sealed in fluid communication with the mandrel's bore (172), and its "upstream" end has the pivotable seal end 258 sealed in fluid communication with the rotor's bore (115). The arrangement of the upstream inner beam 250*b* would be opposite. In other words, its "downstream" end would have the pivotable seal end 258 sealed in fluid communication with the mandrel's bore (172), and its "upstream" end would have the cap seal end 256 sealed in fluid communication with the rotor bore (115). (Reference to upstream and downstream is merely provided for clarity.)

Because the shaft 230 rotates along its length during operation and articulates relative to the joint adapters 242*a-b*, the jointed ends 258 of the beams 250*a-b* handle issues with the movement of the inner beams 250*a-b* at the pockets 236 of the shaft's ends 234*a-b*, while the seal cap ends 256 stay fixed relative to the adapters 242*a-b*. Seals 238, such as an O-ring or other form of seal, can be used between the jointed ends 258 and the pivot pockets 236 to seal the interface between the inner beams 250*a-b* and shaft's bore 232. The seals 238 are preferably located at the center of rotation of the respective universal joints 240*a-b* to reduce the geometrical changes at the sealing site as the joints 240*a-b* articulate, thereby maintaining a good seal. Moreover, backup rings 239 as shown in FIG. 7C can be used on either side of the seals 238 to prevent extrusion of the seals 238. These backup rings 239 are preferably made from a material that will not damage the sealing surface of the beam's jointed ends 258 if they should contact.

As noted above, the seal cap ends 256 of the inner beams 250*a-b* may fit snuggly in the passages 243 of the adapters 242*a-b* to help with sealing, while the pivot ends 258 pivotably fit in the shaft's pockets 236. The seal cap ends 256 of the inner beams 250*a-b* can affix in the intermediate passages 243 in the joint adapters 242*a-b* in a number of suitable ways. As shown, for example, the seal cap ends 256 can thread into the intermediate passages 243 and can include O-rings or other seal elements.

As shown, the necks 254 of the inner beams 250*a-b* preferably have an outer diameter along most of its length that is less than the diameters of the ends 256 and 258. This may allow for some flexure and play in the necks 254. In fact, the necks 254 can have thin walls for the middle sections of the beams 250*a-b* that allow for deflection if the shaft 230 does come into contact with the beams 250*a-b*. This allows the beams 250*a-b* to flex when used at high angles of articulation without risk of severely damaging parts. Since the shaft 230 is free to slide along the inner beams 250*a-b*, the sealing surfaces (especially those associated with the pivotable seal end 258) are designed long enough to provide an adequate seal when the shaft 230 is in any acceptable position and articulation angle.

Ultimately, the arrangement of the inner beams 250*a-b* seals fluid from communicating between the bore 232 of the shaft 230 and the universal joints 240*a-b*. Although fluid may still pass through bores 252 of the beams 250*a-b*, the inner beams 250*a-b* prevent fluid flow from the universal joints 240*a-b* from passing into the shaft's bore 232 and around the conductor conduit (108), which could damage the conduit (108). Likewise, the inner beams 250*a-b* prevent fluid from the shaft's bore 232 from passing into the universal joints 240*a-b*, which can damage the joints 240*a-b*. Additionally, the inner beams 250*a-b* help maintain a pressure differential, which can be particularly needed when steering by controlling fluid flow through bore 232.

For the seals at the inner beams 250*a-b*, the geometry of the O-ring gland (i.e., gland width and depth), expected operating pressures, and clearances required for operation results in a clearance requirement, which can be referred to as Total Diametral Clearance (TDC), between the shaft 230 and the inner beams 250*a-b*. The TDC required increases at greater bend angles at the joint 240*a-b* because the articulating motion shifts the transmission shaft 230 relative to the inner beams 250*a-b* and the sealing interfaces consequently do not remain concentric. In one arrangement, the inner beams 250*a-b* can use a 0.030-inch Total Diametral Clearance to accommodate the sealing by the O-rings 238 and the backup rings 239.

Even with this added clearance, it is still possible for contact to occur between the inside of the transmission shaft 230 and the inner beams 250*a-b* when the joints 240*a-b* are bent at high angles, such as discussed previously with reference to FIG. 5C. For this reason, should the transmission shaft 230 contact the inner beams 250*a-b*, the inner beams 250*a-b* preferably act as flexible cantilever beams that can readily deflect to prevent a large resulting force at the contact point, which could damage the inner beams' sealing surfaces.

To reduce contact on sides of the beams' sealing surfaces and to prevent fluids from invading the joints 240*a-b*, the seal formed between the shaft 230 and the inner beams 250*a-b* can be further improved in various way, such as using alternatives to the O-Rings 238 and the backup rings 239. Even with more reliable seal designs, however, using a smaller Total Diametral Clearance (TDC) may further help prevent ingress of fluid into the joints 240*a-b*. The preferred embodiment of a partial pivot seal via flexible cantilever beams requires the balance of two opposing trends, minimizing TDC for reliable seal function while minimizing force generated from beam deflection.

In the end, the inner beams 250*a-b* are preferably flexible for use with housing bend angles of 1.0-degree and more, which would equate to greater angles of articulation for the joints 240*a-b* and especially for the downhole joint 240*a*. As noted herein, the inner beams 250*a-b* can be made flexible by reducing the inner beams' cross-sections to decrease the resulting force and/or by increasing the beams 250*a-b* overall length. Alternatively or in addition to these, the inner beams 250*a-b* can be composed of titanium to reduce the load by approximately 50% compared to steel due to the relative stiffness of titanium compared to steel.

Rather than transferring torque through interference fits as in the prior art, the universal joints 240*a-b* transfer torque through their universal joint connections to the ends 234*a-b* of the transmission shaft 230. The inner beams 250*a-b* seal the joints 240*a-b* and shaft's bore 232 from one another for passage of the conductor conduit (108) and/or drilling fluid through the shaft 230. With this arrangement, the transmission shaft 230 as disclosed herein can be composed of alloy steel or other conventional metal for downhole use, although the shaft 230 could be composed of titanium if desired. For their part, the inner beams 250*a-b* can be composed of alloy steel or titanium, as noted above.

Figure 1A:
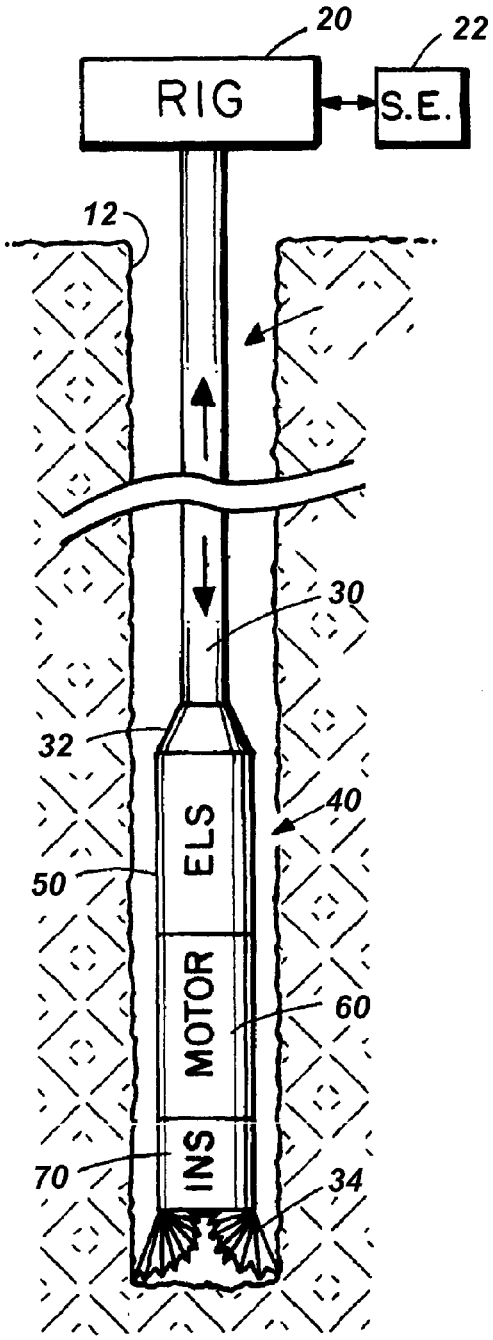
Fig. 1A (Prior Art)
FIG. 1A conceptually illustrates a prior art drilling system disposed in a borehole.
Figure 1B:
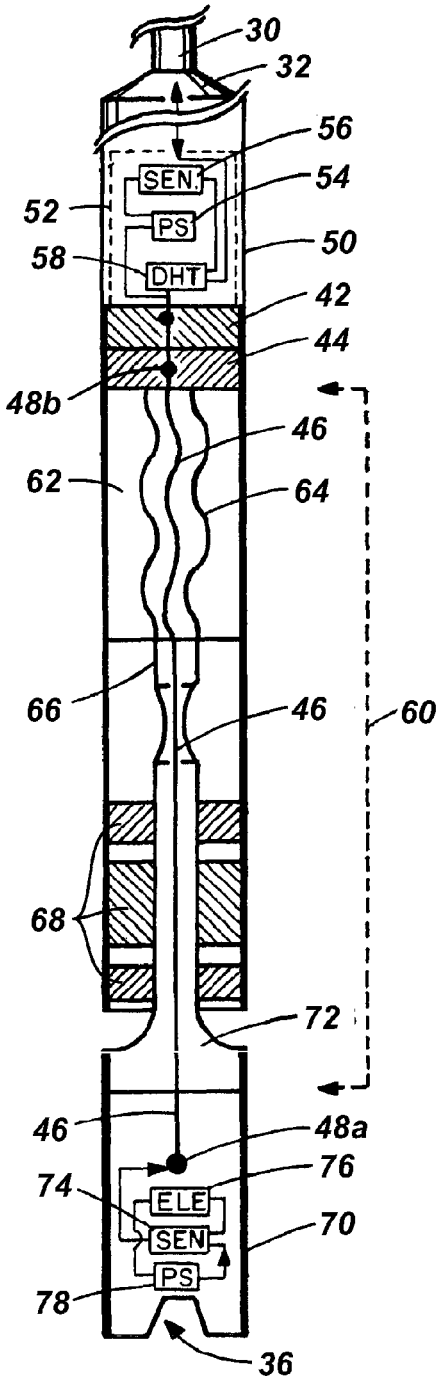
Fig. 1B (Prior Art)
FIG. 1B illustrates a prior art bottom hole assembly in more detail.
Figure 2:
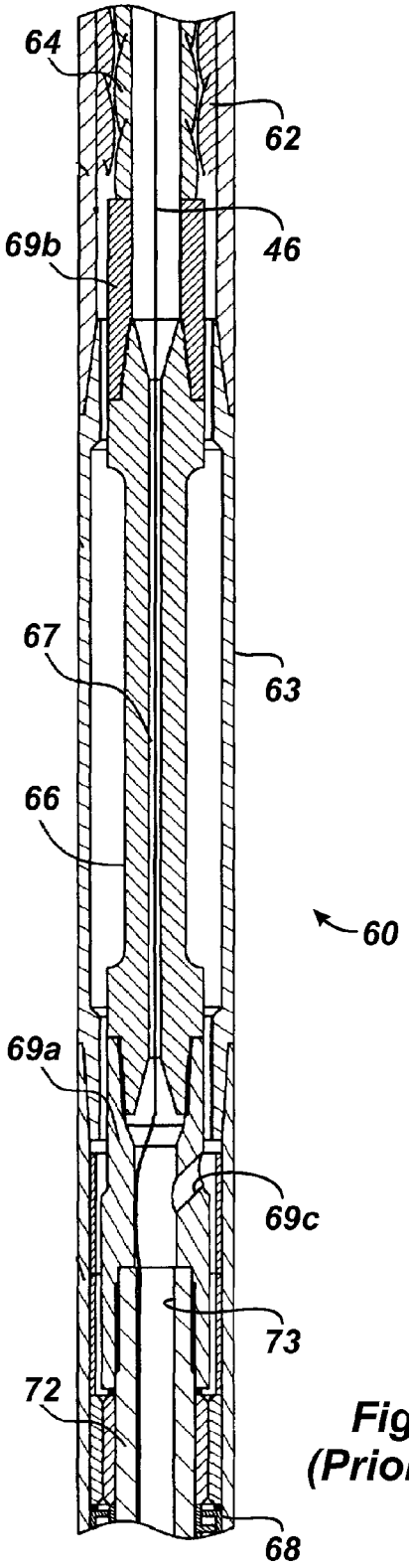
Fig. 2 (Prior Art)
FIG. 2 shows a transmission section of a prior art mud motor having a flex shaft with conductors passing therethrough.

Moreover, the transmission shaft 230 can be much shorter than the conventional flex shaft composed of titanium used in prior art mud motors (See e.g., FIG. 2), and the transmission section 222 and sole shaft 230 can be much shorter and simpler than the multiple driveline shafts used in prior art mud motors (See e.g., FIGS. 3A-3D). In fact, in some implementations for a comparable motor application, the sole transmission shaft 230 can be about 2 to 3 feet in length as opposed to the 4 to 5 feet length required for a titanium flex shaft with shrunk fit adapters of the prior art.

Figure 8A:
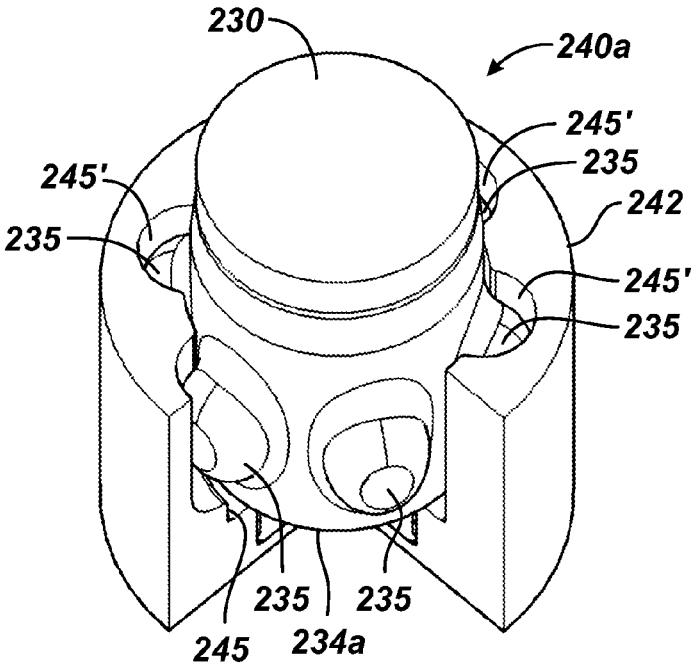
FIG. 8A shows a cutaway view of the universal joint for the transmission shaft of FIGS. 5A-5B.

Additional details of one of the universal joints 240*a* are shown in the cutaway view of FIG. 8A. As shown, the universal joint 240*a* on the transmission shaft 230 has a plurality of the projections 235 formed around the shaft's distal end 234*a*. The projections 235 extend radially from the surface of the end 234*a* and mate with the slots 245' of the adapter's socket 245 for torque transfer in a constant velocity joint. The projections 235 are machined from a larger diameter initial body of the shaft 230. Each of the projections 235 has an elliptical cross-section and is sized to correspond to the size of the slots 245' of the adapter's socket 245.

Torsional load transfer occurs between the elliptical surfaces of the projections 235 and the cylindrical surfaces of the slots 245' of the adapter 242*a*, creating a larger contact area than in a conventional design using bearings placed in dimples in a shaft's end. In one embodiment, additional stress concentration reduction can be achieved by including variable radius fillets around the base of each projection 235 where the projections 235 intersect the cylindrical body of the shaft 230. Additional details of this arrangement are disclosed in U.S. Pat. No. 8,342,970, which is incorporated herein by reference.

Figure 8B:
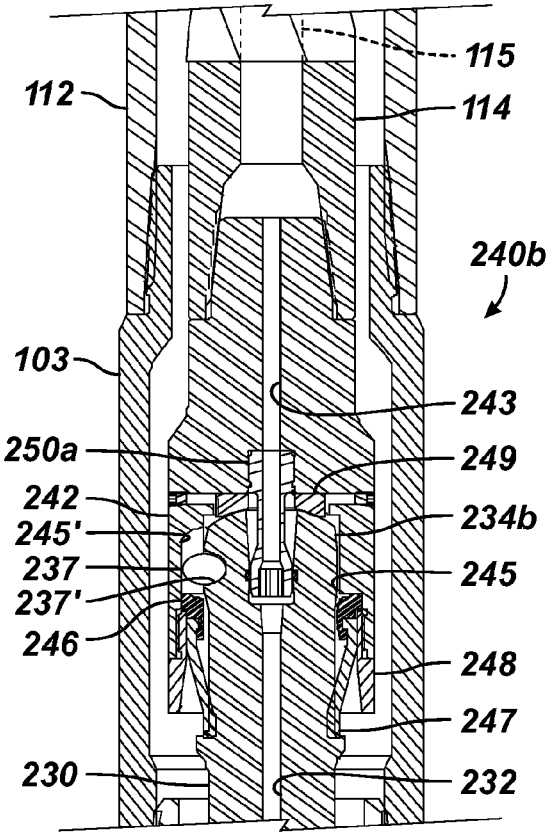
FIG. 8B shows a cross-sectional view of another universal joint for the transmission shaft of FIGS. 5A-5B.

An alternative joint arrangement is shown in FIG. 8B. Here, the universal joint 240*b* includes a joint member or adapter 242*b* having a socket 245 in which the end 234*b* of the shaft 230 positions. A thrust seat 249 is provided between the end 234*b* and the socket 245. Bearings 237 dispose in bearing pockets 237' in the end 234*b* of the shaft 230 and slide into the bearing slots 245' in the socket 245 of the adapter 242*b*. A retaining split ring 246 disposes about the end of the shaft 230 adjacent the socket 245 and connects to the joint adapter 242*b*. In addition, a seal boot 247 connects from the split ring 246 to the shaft 230 to keep drilling fluid from entering and to balance pressure for lubrication oil in the drive to the internal pressure of the drilling motor. A seal collar 248 then holds the seal assembly on the joint adapter 242*b*.

As shown, the inner beams 250*a-b* have lengths dictated so that the jointed ends 258 lie at about the center of rotation of the joints 240*a-b*. In other implementations, the inner beams 250*a-b* could have greater lengths extending further inside the shaft's bore 232 and may rely more on bending of the necks 254 and a sliding type of seal with the bore 252 rather than the pivotable seal depicted. Moreover, as previously shown, the inner beams 250*a-b* affix with the seal cap ends 256 to the inside of the passages 243 on the adapters 240*a-b*. Other arrangements can be used in which these seal cap ends 256 affix at different locations on the adapters 240*a-b*. In fact, the ends of the beams 250*a-b* can affix at the outside ends of the adapters 240*a-b*.

Figure 9:
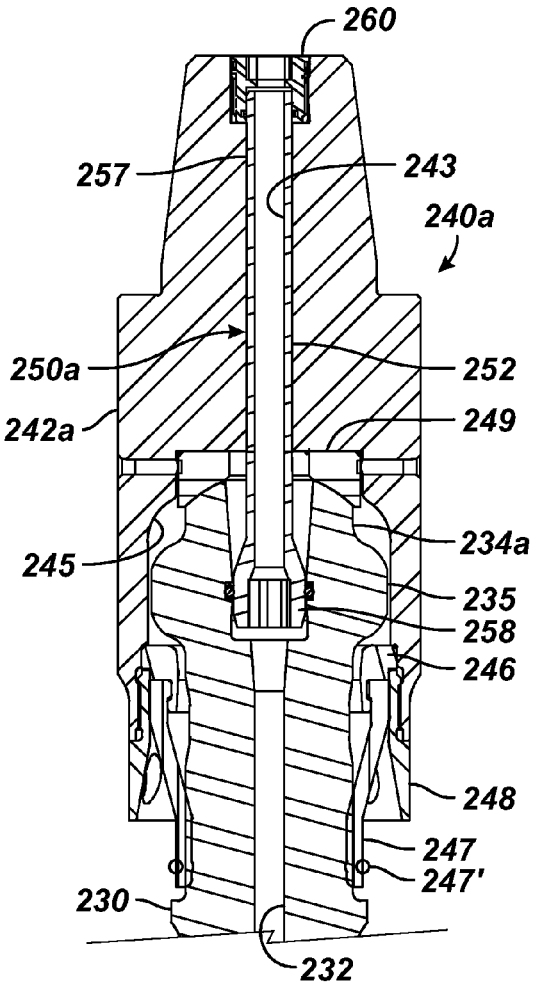
FIG. 9 shows another arrangement of an internal beam for a transmission shaft and universal joint according to the present disclosure.

As one example, FIG. 9 shows another arrangement of an inner beam 250*a* for a transmission shaft 230 and universal joint 240*a* according to the present disclosure. The inner beam 250*a* has a pivotable seal end 258 that fits in the end 234*a* of the shaft 230 as before. However, the inner beam 250*a* has an elongated mid-section 252 that extends through the passage 243 of the adapter 242*a*. The distal end 257 of the beam 250*a* then affixes and seals on the outside end of the adapter 242*a* with a seal cap 260.

Preparing the transmission section 220 for this arrangement can be similar to the steps disclosed above. The inner beam 250*a* installs in the passage 243 of the adapter 242*a*, and the seal cap 260 disposes on the end 257 by threading into a threaded area of the adapter's passage 243. An internal ledge or shoulder in the seal cap 260 can retain the end 257 of the inner beam 250*a*, or the cap 260 can thread onto the beam's end 257. To seal the connection, O-rings or other forms of sealing can be used between the seal cap 260 to seal against beam's end 257 and adapter's passage 243. The adapter 242*a* can then install on the end 234*a* of the shaft 230 with the beam's jointed seal end 258 sealing in the shaft's bore 232.

Figure 10A:
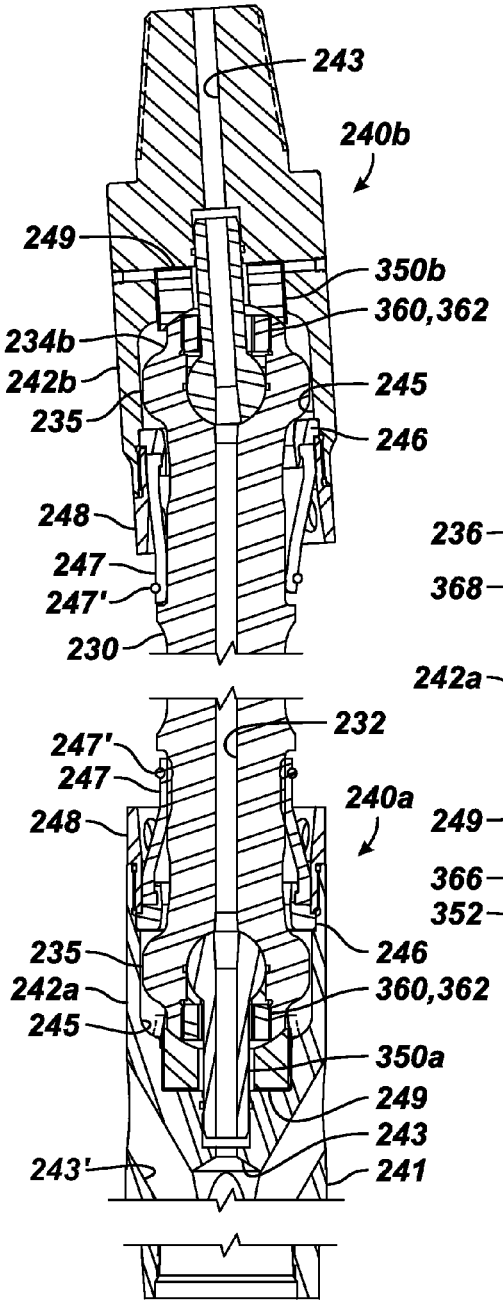
FIG. 10A shows another arrangement of transmission shaft and universal joints for use in the transmission section of FIGS. 5A-5B.
Figure 10B:
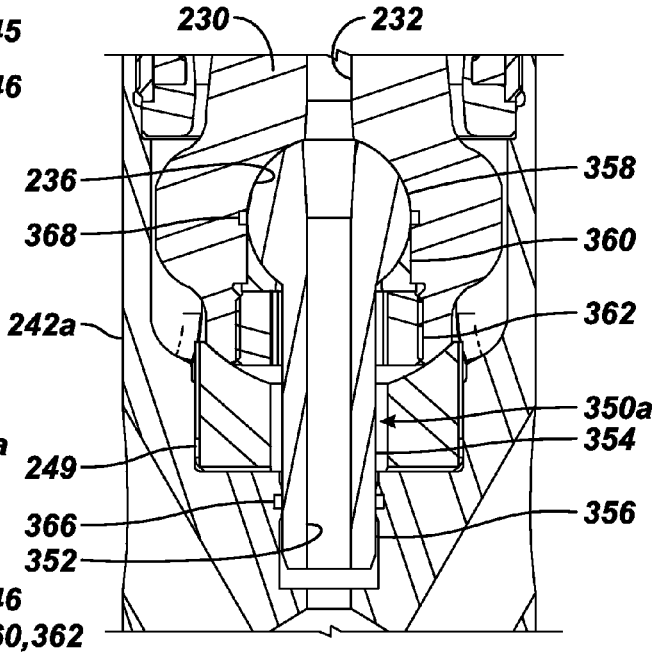
FIG. 10B shows a detail of one of the joints on the transmission shaft of FIG. 10A.

Turning now to FIGS. 10A-10B, another arrangement of inner beams 350*a-b* is shown in isolated detail for a transmission shaft 230 and universal joints 240*a-b*, which can be used in a transmission section 220 as in FIGS. 5A-5B. FIG. 10A shows the transmission shaft 230, the universal joints 240*a-b*, and the inner beams 350*a-b* in cross-section, and FIG. 10B shows a detail of one of the universal joints 240*a* and the inner beam 350*a* on an end of the transmission shaft 230.

Details of the transmission shaft 230 are similar to those discussed previously so like reference numerals are used for comparable components. Accordingly, the transmission shaft 230 defines the through-bore 232 to convey a conductor conduit (108) from the rotor (114) to the instrument section associated with the mandrel (170) and/or to convey diverted drilling fluid from the rotor's bore (115) to the mandrel's bore (172) during motor control.

To deal with fluid sealing at the connections of the shaft's ends 234*a-b* to the universal joints 240*a-b*, the inner beams 350*a-b* having their own internal passages or bores 352 install in the transmission shaft's bore 232. As described herein, the inner beams 350*a-b* help seal passage of the conduit (108) and/or fluid flow through the universal joints 240*a-b*, and the inner beams 350*a-b* flex and/or pivot to compensate for eccentricity of the transmission section 220 and any bend of the drilling motor's housing. The inner beams 350*a-b* insert into the joint adaptors 242*a-b* and into the shaft's bore 232 with seals to prevent ingress and egress of fluid. For their part, the joints 240*a-b* for the shaft 230 use thrust seats 249 and are filled with oil so rubber boots 247 and other features noted previously can act as barriers between the lubricating oil and the drilling fluid.

To prepare the transmission section 220, first (jointed) seal ends 358 of the inner beams 350*a-b* insert in pockets 236 at ends of the shaft's bore 232. Packing seals 360 install around the jointed ends 358, and retaining rings 362 thread in the pockets 236 to hold the packing seals 360 and jointed ends 358 in place. In addition to the packing seals 360, additional seals 368, such as O-rings or other form of seals, can be used between the pivot ends 358 and the pivot pockets 236 to seal the interface between the inner beams 350*a-b* and shaft's bore 232. These seals 368 are preferably located at the center of rotation of the respective universal joints 240*a-b* to reduce the geometrical changes at the sealing site as the joints 240*a-b* articulate, thereby maintaining a good seal.

The thrust seats 249 and joint adapters 242*a-b* then fit on the ends 234*a-b* of the shaft 230. As this is done, second (sliding) stem ends 356 of the inner beams 350*a-b* install in the passages 243 of the joint adapters 242*a-b*. Eventually, the various features of boots 247, retainers 247' and 248, and the like are assembled on the universal joints 240*a-b*, and the reservoirs of the joints 240*a-b* are filled with oil.

In later stages of assembly, the conductor conduit (108) (if used) can be run through the universal joint's adapters 242*a-b*, the bores 352 of the inner beams 350*a-b*, and the shaft's bore 232. Eventually, the conductor conduit (108) can be run to a point further in the drive mandrel 170.

As best shown in the detail of FIG. 10B, each of the inner beams (only 350*a* is shown) has the sliding stem end 356 connected by a neck 354 to the jointed end 358, and the bore 352 extends from the one end 356 to the other end 358 through the inner beam 350*a*. The sliding end 356 inserts into the adapter's passage 243 with a sliding seal interface, whereas the jointed end 358 inserts into the pivot pocket 236 defined in the shaft's bore 232 with a pivot seal interface. The shaft's pivot pocket 236 is machined to allow for articulation of the jointed end 358 therein.

For this "downstream" inner beam 350*a*, its "downstream" end has the sliding end 356 sealed in fluid communication with the mandrel's bore (172), and its "upstream" end has the jointed end 358 sealed in fluid communication with the rotor's bore (115). The arrangement of the "upstream" inner beam 350*b* would be opposite to this.

Rather than transferring torque through interference fits as in the prior art, the universal joints 240*a-b* transfer torque through their universal joint connections to the ends 234*a-b* of the transmission shaft 230. The inner beams 350*a-b* seal the joints 240*a-b* and shaft's bore 232 from one another for passage of the conductor conduit (108) and/or drilling fluid through the shaft 230. With this arrangement, the transmission shaft 230 as disclosed herein can be composed of alloy steel or other conventional metal for downhole use, although the shaft 230 could be composed of titanium if desired. For their part, the inner beams 350*a-b* can be composed of alloy steel or titanium.

Because the shaft 230 rotates along its length during operation and articulates relative to the joint adapters 242*a-b*, the jointed ends 358 of the beams 350*a-b* handle issues with the movement of the inner beams 350*a-b* at the pockets 236 of the shaft's ends 234*a-b*, while the sliding ends 356 stay relatively fixed relative to the adapters 242*a-b*. The sliding ends 356 of the inner beams 350*a-b* fit snuggly in the passages 243 of the adapters 242*a-b* to help with sealing. The sliding ends 356 of the inner beams 250*a-b* can seal in a number of suitable ways. As shown, for example, the sliding ends 356 may press past raised seals 366 inside the adapters' passages 243.

As shown, the necks 354 of the inner beams 350*a-b* preferably have an outer diameter along most of their lengths that is less than the diameter of at least the ends 358. This may allow for some flexure and play in the necks 354. In fact, the necks 354 can have thin walls for the middle sections of the beams 350*a-b* that allow for deflection if the shaft 230 does come into contact with the beams 350*a-b*. This allows the beams 350*a-b* to flex when used at high angles of articulation without risk of severely damaging parts. Since the shaft 230 is free to slide along the inner beams 350*a-b*, the sealing surfaces (especially those associated with the sliding end 356) are designed long enough to provide an adequate seal when the shaft 230 is in a shifted position and bent at an articulation angle.

Ultimately, the arrangement of the inner beams 350*a-b* seals fluid from communicating between the bore 232 of the shaft 230 and the universal joints 240*a-b*. Although fluid may still pass through bores 352 of the beams 350*a-b*, the inner beams 350*a-b* prevent lubricating fluid flow from the universal joints 240*a-b* from passing into the shaft's bore 232 and around the conductor conduit (108), which could damage the conduit (108). Likewise, the inner beams 350*a-b* prevent fluid from the shaft's bore 232 from passing into the universal joints 240*a-b*, which can damage the joints 240*a-b*.

As disclosed above, the transmission section 220 having the transmission shaft 230 and universal joints 240*a-b* can be used for a downhole mud motor to pass one or more conductors (e.g., in a conductor conduit (108)) to electronic components near the drill bit. Yet, the transmission section 220 can also find use in other applications. For example, the transmission shaft 230 can be used to convey any number of elements or components other than wire conductor conduit in a sealed manner between uphole and downhole elements of a bottom hole assembly. In fact, the transmission shaft 230 can allow fluid to communicate alternatively outside the shaft 230 or inside the shaft's passage 232 in a sealed manner when communicated between a mud motor and a drive shaft for directional drilling.

The foregoing description of preferred and other embodiments is not intended to limit or restrict the scope or applicability of the inventive concepts conceived of by the Applicants. It will be appreciated with the benefit of the present disclosure that features described above in accordance with any embodiment or aspect of the disclosed subject matter can be utilized, either alone or in combination, with any other described feature, in any other embodiment or aspect of the disclosed subject matter. For example, although the motor section 110 disclosed herein has included a positive cavity positive displacement (PCPD) motor, it will be appreciated that any type of hydraulic drilling motor can be used. As but one example, the motor section 110 disclosed herein can include a turbine drilling motor. Such as turbine motor has stator vanes that direct flow to rotor vanes, which rotate a shaft to achieve the drilling action.

In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A downhole assembly for a drill string, the assembly comprising:

a motor disposed on the drill string and having a rotor driven by flow of drilling fluid, the rotor defining a first bore;

a mandrel disposed downhole from the motor and defining a second bore;

a shaft transferring the drive of the rotor to the mandrel, the shaft defining a third bore and having first and second ends, the first end coupled to the rotor with a first universal joint, the second end coupled to the mandrel with a second universal joint; and first and second inner beams disposed respectively at the first and second ends of the shaft coupled to the first and second universal joints, the first and second inner beams sealing communication of the first bore of the rotor with the second bore of the mandrel through the third bore of the shaft, wherein at least one of the first and second inner beams defines an internal passage and has a proximal end and a distal end, the distal end sealing communication of the internal passage with the respective at least one of the first bore of the rotor and the second bore of the mandrel, the proximal end sealing communication of the internal passage with the third bore of the shaft, and wherein the proximal end of the at least one inner beam comprises a jointed end pivotably sealed in the third bore of the shaft.

2. The assembly of claim 1, wherein the first universal joint and the first inner beam compensate for eccentricity in motion of the rotor; and wherein the second universal joint and the second inner beam compensate for a bend in the downhole assembly.

3. The assembly of claim 1, wherein each of the first and second inner beams is at least partially flexible along its length to compensate respectively for articulation at the first and second universal joints.

4. The assembly of claim 1, wherein the at least one inner beam comprises the first inner beam defining a first of the internal passage and having a first of the proximal end and a first of the distal end, the first distal end sealing communication of the first internal passage with the first bore of the rotor, the first proximal end sealing communication of the first internal passage with the third bore of the shaft, which communicates with the second bore of the mandrel.

5. The assembly of claim 1, further comprising a flow control controlling at least some of the flow through the downhole assembly between a first route and a second route; the first route passing along the rotor, outside the shaft, and into the second bore of the mandrel; the second route passing through the first bore of the rotor, through the third bore of the shaft, through the first and second inner beams, and into the second bore of the mandrel.

6. The assembly of claim 1, further comprising one or more conductors passing from the first bore of the rotor, through the third bore of the shaft, through the first and second inner beams, and into the second bore of the mandrel.

7. The assembly of claim 1, wherein the first and second universal joints each comprise a joint member coupled to the rotor or the mandrel and having a socket receiving the first or second end of the shaft therein.

8. The assembly of claim 1, wherein the shaft is composed of an alloy steel, and wherein the first and second inner beams are composed of titanium.

9. The assembly of claim 1, further comprising at least one electronic device associated with the mandrel and in electric communication with at least one conductor for passage through the first, second, and third bores.

10. The assembly of claim 1, wherein a coupling between the second universal joint and the mandrel defines a port communicating an annular space around the shaft in the downhole assembly with the second bore of the mandrel.

11. The assembly of claim 4, wherein the first distal end of the first inner beam comprises a cap end fixedly sealed to the first universal joint.

12. The assembly of claim 4, wherein the first distal end of the first inner beam comprises a stem end slideably sealed in a first passage of the first universal joint.

13. The assembly of claim 4, wherein the first inner beam defines a flexible neck disposed between the first distal and proximal ends.

14. The assembly of claim 4, wherein the at least one inner beam comprises the second inner beam defining a second of the internal passage and having a second of the proximal end and a second of the distal end, the second distal end sealing communication of the second internal passage with the second bore of the mandrel, the second proximal end sealing communication of the second internal passage with the third bore of the shaft, which communicates with the first bore of the rotor.

15. The assembly of claim 14, wherein the second distal end of the second inner beam comprises a cap end fixedly sealed to the second universal joint.

16. The assembly of claim 14, wherein the second distal end of the second inner beam comprises a stem end slideably sealed in a second passage of the second universal joint.

17. The assembly of claim 6, further comprising at least one sensor associated with the mandrel and in electric communication with the one or more conductors.

18. The assembly of claim 6, further comprising a conductor conduit containing the one or more conductors and passing from the second bore of the mandrel, through the third bore of the shaft, through the first and second inner beams, and to the first bore of the rotor.

19. The assembly of claim 6, wherein the one or more conductors are selected from the group consisting of one or more single strands of wire, a twisted pair, a shielded multi-conductor cable, a coaxial cable, and an optical fiber.

20. The assembly of claim 7, wherein the first and second universal joints each comprise at least one bearing disposed in a bearing pocket in the first or second end of the shaft and received in at least one bearing slot defined in the socket.

21. The assembly of claim 7, wherein the first and second ends of the shaft each comprise at least one integrated projection extending therefrom and received in at least one bearing slot defined in the socket.

22. The assembly of claim 9, wherein the at least one electronic device comprises a sensor selected from the group consisting of a gamma radiation detector, a neutron detector, an inclinometer, an accelerometer, an acoustic sensor, an electromagnetic sensor, a pressure sensor, and a temperature sensor.

23. The assembly of claim 9, further comprising a sonde disposed uphole of the motor and in electric communication with the at least one conductor.

24. A downhole assembly for a drill string, the assembly comprising:

a motor disposed on the drill string and having a rotor driven by flow of drilling fluid, the rotor defining a first bore;

a mandrel disposed downhole from the motor and defining a second bore;

a shaft transferring the drive of the rotor to the mandrel, the shaft defining a third bore and having first and second ends, the first end coupled to the rotor with a first universal joint, the second end coupled to the mandrel with a second universal joint; and first and second inner beams disposed respectively at the first and second ends of the shaft coupled to the first and second universal joints, the first and second inner beams sealing communication of the first bore of the rotor with the second bore of the mandrel through the third bore of the shaft, wherein at least one of the first and second inner beams defines an internal passage and has a proximal end and a distal end, the distal end sealing communication of the internal passage with the respective at least one of the first bore of the rotor and the second bore of the mandrel, the proximal end sealing communication of the internal passage with the third bore of the shaft, and wherein the at least one inner beam defines a flexible neck disposed between the distal and proximal ends.

25. The assembly of claim 24, wherein the first universal joint and the first inner beam compensate for eccentricity in motion of the rotor; and wherein the second universal joint and the second inner beam compensate for a bend in the downhole assembly.

26. The assembly of claim 24, wherein each of the first and second inner beams is at least partially flexible along its length to compensate respectively for articulation at the first and second universal joints.

27. The assembly of claim 24, wherein the at least one inner beam comprises the first inner beam defining a first of the internal passage and having a first of the proximal end and a first of the distal end, the first distal end sealing communication of the first internal passage with the first bore of the rotor, the first proximal end sealing communication of the first internal passage with the third bore of the shaft, which communicates with the second bore of the mandrel.

28. The assembly of claim 27, wherein the first proximal end of the first inner beam comprises a jointed end pivotably sealed in the third bore of the shaft.

29. The assembly of claim 27, wherein the first distal end of the first inner beam comprises a cap end fixedly sealed to the first universal joint.

30. The assembly of claim 27, wherein the first distal end of the first inner beam comprises a stem end slideably sealed in a first passage of the first universal joint.

31. The assembly of claim 24, wherein the at least one inner beam comprises the second inner beam defining a second of the internal passage and having a second of the proximal end and a second of the distal end, the second distal end sealing communication of the second internal passage with the second bore of the mandrel, the second proximal end sealing communication of the second internal passage with the third bore of the shaft, which communicates with the first bore of the rotor.

32. The assembly of claim 24, further comprising a flow control controlling at least some of the flow through the downhole assembly between a first route and a second route; the first route passing along the rotor, outside the shaft, and into the second bore of the mandrel; the second route passing through the first bore of the rotor, through the third bore of the shaft, through the first and second inner beams, and into the second bore of the mandrel.

33. The assembly of claim 24, further comprising one or more conductors passing from the first bore of the rotor, through the third bore of the shaft, through the first and second inner beams, and into the second bore of the mandrel.

34. The assembly of claim 24, further comprising at least one electronic device associated with the mandrel and in electric communication with at least one conductor for passage through the first, second, and third bores.

35. The assembly of claim 24, further comprising a sonde disposed uphole of the motor and in electric communication with at least one conductor for passage through the first, second, and third bores.

36. The assembly of claim 31, wherein the second proximal end of the second inner beam comprises the jointed end pivotably sealed in the third bore of the shaft.

37. The assembly of claim 31, wherein the second distal end of the second inner beam comprises a cap end fixedly sealed to the second universal joint.

38. The assembly of claim 31, wherein the second distal end of the second inner beam comprises a stem end slideably sealed in a second passage of the second universal joint.

* * * * *